US006002896A

United States Patent [19]

Miyamoto et al.

[11] Patent Number: 6,002,896

[45] Date of Patent: Dec. 14, 1999

[54] PROCESS CARTRIDGE AND ELECTROPHOTOGRAPHIC IMAGE FORMING APPARATUS

[75] Inventors: Jun Miyamoto, Susono; Kouji Miura, Mishima; Takeshi Arimitsu, Numazu, all of Japan

[73] Assignee: Canon Kabushiki Kaisha, Tokyo, Japan

[21] Appl. No.: 08/807,750

[22] Filed: Feb. 27, 1997

[30] Foreign Application Priority Data

Feb. 27, 1996 [JP] Japan ..... 8-065224
Feb. 12, 1997 [JP] Japan ..... 9-027734

[51] Int. Cl.[6] ..... G03G 21/18

[52] U.S. Cl. ..... 399/114; 399/111

[58] Field of Search ..... 399/107, 110, 399/114, 111, 116, 302, 308

[56] References Cited

U.S. PATENT DOCUMENTS

| | | | |
|---|---|---|---|
| 4,462,677 | 7/1984 | Onoda . | |
| 4,470,689 | 9/1984 | Nomura et al. . | |
| 4,609,276 | 9/1986 | Mitzutani | 399/111 |
| 4,708,455 | 11/1987 | Kubota et al. | 399/111 |
| 4,737,817 | 4/1988 | Kando et al. | 399/114 |
| 5,113,220 | 5/1992 | Kwak . | |
| 5,231,453 | 7/1993 | Nakai et al. | 399/114 |
| 5,266,999 | 11/1993 | Yashiro | 399/114 |
| 5,428,426 | 6/1995 | Inomata et al. | 399/308 X |
| 5,500,714 | 3/1996 | Yashiro et al. . | |
| 5,585,889 | 12/1996 | Shishido et al. . | |
| 5,697,017 | 12/1997 | Rooke et al. | 399/114 X |

FOREIGN PATENT DOCUMENTS

| | | |
|---|---|---|
| 0 549 089 | 6/1993 | European Pat. Off. . |
| 0 613 060 | 8/1994 | European Pat. Off. . |
| 0 738 940 | 10/1996 | European Pat. Off. . |
| 0 794 470 | 9/1997 | European Pat. Off. . |
| 4-114172 | 4/1992 | Japan . |

*Primary Examiner*—Sandra Brase
*Attorney, Agent, or Firm*—Fitzpatrick, Cella, Harper & Scinto

[57] ABSTRACT

A process cartridge detachably mountable to a main assembly of an image forming apparatus includes a cartridge frame, an electrophotographic photosensitive member, a processor actable on the electrophotographic photosensitive member, and a cartridge shutter capable of taking a closing position for covering an exposed portion of the electrophotographic photosensitive member exposed from the cartridge frame and an open position for exposing a part of the electrophotographic photosensitive member. The cartridge shutter has a first portion and a second portion which are swingable relative to each other, with the first portion being disposed downstream of the second portion with respect to a movement direction of the shutter toward the open position. The cartridge shutter takes a position above the cartridge frame when the process cartridge is mounted to a mounting position of the main assembly of the apparatus and the shutter takes the open position.

51 Claims, 11 Drawing Sheets

PROCESS CARTRIDGE AND ELECTROPHOTOGRAPHIC IMAGE FORMING APPARATUS

FIELD OF THE INVENTION AND RELATED ART

The present invention relates to a process cartridge which is installed in the main assembly of an electrophotographic image forming apparatus in order to form an image on recording medium using an electrophotographic system. It also relates to an electrophotographic image forming apparatus.

An electrophotographic image forming apparatus, which employs an electrophotographic image formation process, has been employing a process cartridge system. In a process cartridge system, an electrophotographic photosensitive member, and processing means which act on the electrophotographic photosensitive member, are integrated in the form of a cartridge which is detachably installed in the main assembly of an electrophotographic image forming apparatus.

According to a process cartridge system, an electrophotographic image forming apparatus can be maintained by a user alone, eliminating the need for service personnel. Therefore, operational efficiency can be remarkably improved. With this reason, a process cartridge system has been widely used in the field of an electrophotographic image forming apparatus.

Further, recent technologies have made it possible to use a process cartridge in color printing or the like. In this case, color developing means and an intermediate transfer member are appropriately disposed so as to work with the electrophotographic photosensitive member of a process cartridge which integrally comprises an electrophotographic photosensitive member and processing means (charging means and cleaning means, which acts on the electrophotographic photosensitive member).

In the case of the process cartridge described above, the opening, through which the electrophotographic photosensitive member is exposed, is rendered relatively large to allow the electrophotographic photosensitive member to be exposed to an exposing means, a developing means, and an intermediary transfer member.

As for the shutter for protecting the electrophotographic photosensitive member, the applicant of the present invention has already invented an extremely effective shutter (U.S. Pat. Nos. 4,462,677 and 4,470,689).

SUMMARY OF THE INVENTION

The primary object of the present invention is to provide a process cartridge capable of effectively protecting an electrophotographic photosensitive member, and an electrophotographic image forming apparatus in which such a process cartridge is detachably installable.

Another object of the present invention is to provide a process cartridge whose shutter can be opened or closed in a manner to closely follow the exterior surface of the process cartridge, and an electrophotographic image forming apparatus in which such a process cartridge is detachably installable.

Another object of the present invention is to provide a process cartridge whose shutter for covering the exposed portion of the electrophotographic photosensitive member has a smaller locus than those for conventional apparatuses, and an electrophotographic image forming apparatus in which such a process cartridge is detachably installable.

Another object of the present invention is to provide a process cartridge whose shutter is inexpensive, and an electrophotographic image forming apparatus in which such a process cartridge is detachably installable.

Another object of the present invention is to provide a process cartridge in which the space (bottom portion of the cleaning container) into which the waste toner removed from the photosensitive drum free-falls is not reduced, and an electrophotographic image forming apparatus in which such a process cartridge is detachably installable.

Another object of the present invention is to provide a compact process cartridge which remains compact even when the shutter is open, and an electrophotographic image forming apparatus in which such a process cartridge is detachably installable.

According to an aspect of the present invention, a process cartridge, which is detachably installable in the main assembly of an electrophotographic image forming apparatus, comprises: a cartridge frame; an electrophotographic photosensitive member; processing means which act on the electrophotographic photosensitive member; a cartridge shutter capable of taking a covering position, at which it covers the cartridge frame opening through which the electrophotographic photosensitive member is exposed, and an exposing position, to which it is retracted from the covering position to expose a portion of the electrophotographic photosensitive member, wherein the cartridge shutter comprises a first section and a second section, which are located on the downstream side and upstream side, respectively, relative to the opening direction in which the cartridge shutter is moved from the covering position to the exposing position, and are movable toward each other to cover the opening, or away from each other to expose the opening, and wherein as the process cartridge is installed in the appropriate space of the apparatus main assembly, the cartridge shutter is positioned on the top side of the cartridge frame.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Embodiment 1

This embodiment will be described in the order of (1) general structure of an electrophotographic image forming apparatus and a process cartridge, and (2) drum shutter structure.

(1) General Structure

Figure 1:
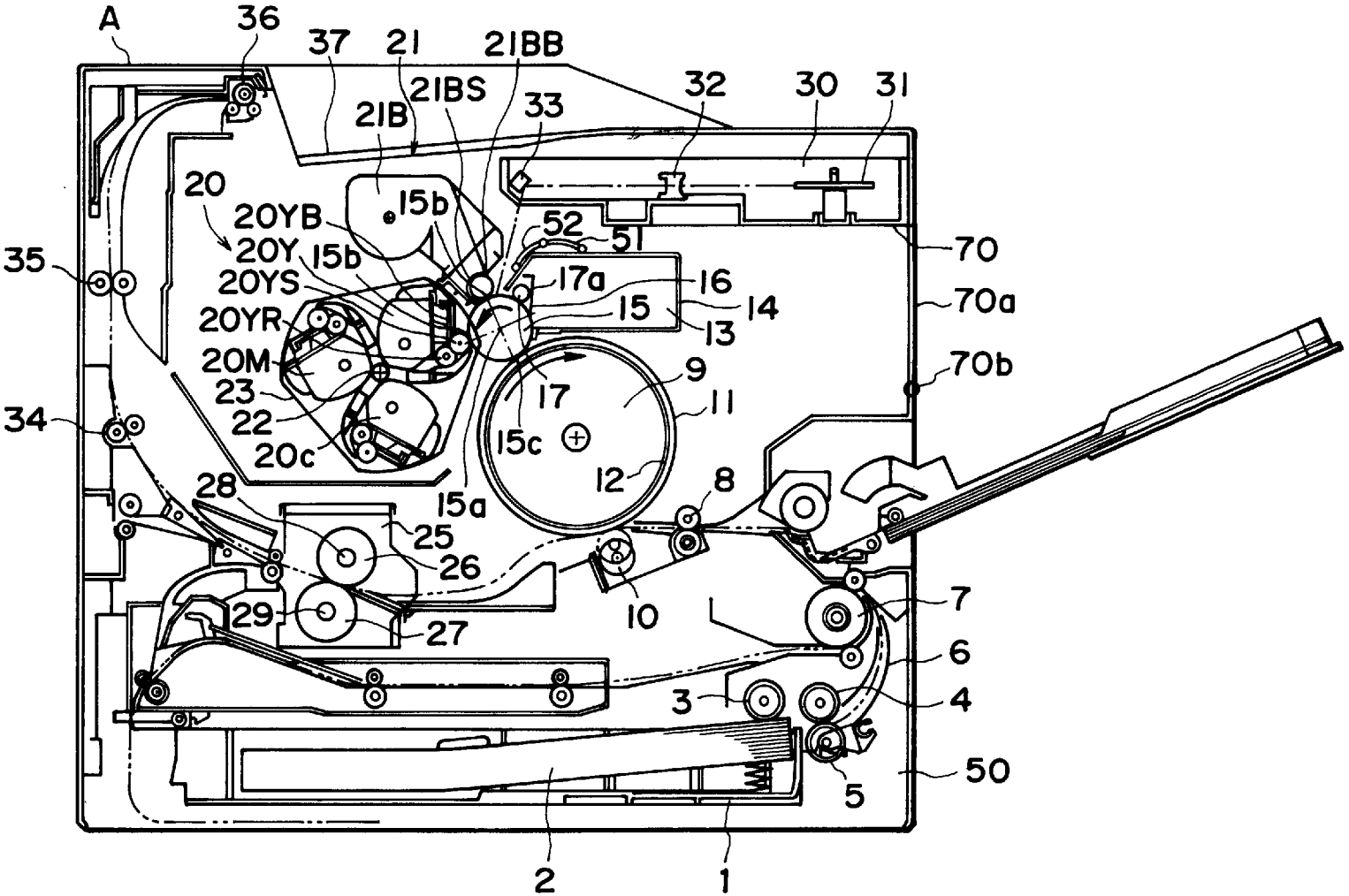
FIG. 1 is a vertical section of an electrophotographic image forming apparatus to which the present invention is applicable.
Figure 2:
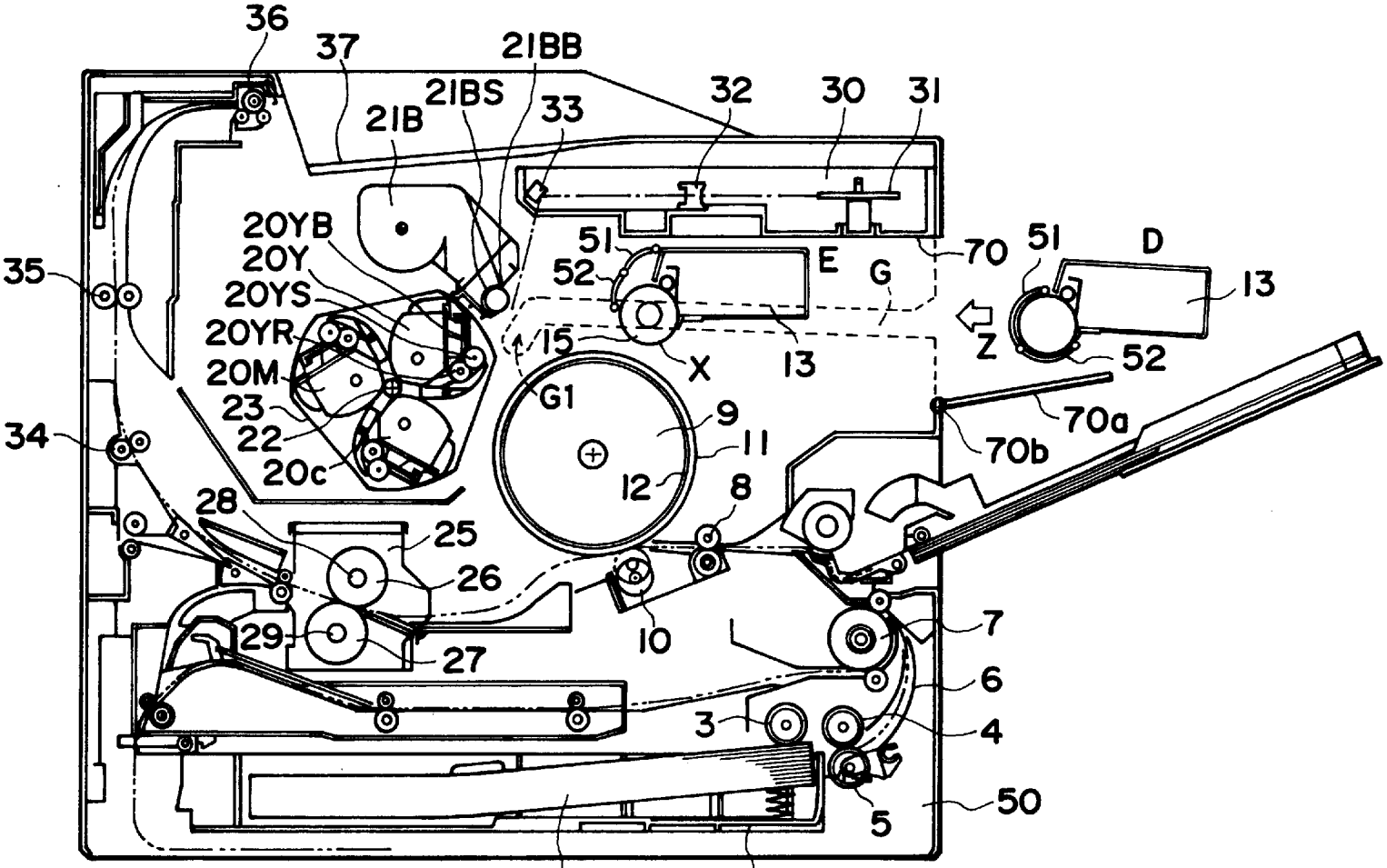
FIG. 2 is a vertical section of an electrophotographic image forming apparatus, and shows how a process cartridge is installed.

FIG. 1 depicts the general structure of an electrophotographic color image forming apparatus A in which a process cartridge 13 has been installed, and FIG. 2 depicts how the process cartridge 13 is installed into the main assembly 50 of the electrophotographic color image forming apparatus A by opening a cartridge entrance 70.

Referring to FIG. 1, the electrophotographic color image forming apparatus A comprises an image forming section, and an intermediary transfer member 9. The image forming section comprises an electrophotographic photosensitive member 15 in the form of a drum (hereinafter, photosensitive drum), a black color developing device 21B, and three color developing devices 20Y, 20M and 20C. The black color developing device 21B is fixedly disposed, and the color developing devices 20Y, 20M and 20C are rotatable. The images developed in the image forming section are transferred onto the intermediate transfer member 9 in the superimposing manner, and form a color image. The intermediary transfer member 9 temporarily holds this color image, and then transfers it onto a transfer material 2 which is delivered from a transfer material feeding section. The transfer material 2 onto which the color image has been transferred is conveyed to a fixing section 25, in which the color image is fixed to the transfer material 2. Thereafter, the transfer material 2 is discharged by discharge rollers 34, 35 and 36, into a delivery section 37 located on the top surface side of the apparatus main assembly 50. It should be noted here that the rotatable color developing devices 20Y, 20M and 20C, and the stationary black color developing device 21B, can be independently and removably disposed in the apparatus main assembly 50.

Next, the structures of the various sections of the aforementioned electrophotographic image forming apparatus A will be described in detail in a logical sequence.

(Photosensitive Drum Unit)

The process cartridge 13 comprises a photosensitive drum 15, a cleaning blade 16, and a primary charging means 17, which are integrally disposed in a cartridge shell 14. The process cartridge 13 is removably installed in the apparatus main assembly 50, so that as the service life of the photosensitive drum 15 expires, the process cartridge with the expired photosensitive drum 15 can be easily exchanged with a fresh cartridge by a user him/herself. The photosensitive drum 15 in this embodiment is formed by coating an organic photoconductive layer on the external surface of an aluminum cylinder having a diameter of approximately 60 mm. It is rotatively supported by the cartridge shell 14 which doubles as the supporter of the photosensitive drum 15. Adjacent to the peripheral surface of the photosensitive drum 15, the cleaning blade 16 and the primary charging means 17 are disposed. The photosensitive drum 15 is rotated counterclockwise by the driving force transmitted from an unillustrated driving motor to one of the longitudinal ends of the photosensitive drum 15, that is, the longitudinal end located on the rear side of the drawing. The cleaning blade 16 is in contact with the photosensitive drum 15 by the widthwise edge. In this embodiment, a charging roller 17*a* is employed as the charging means. The charging roller 17*a* is in contact with the photosensitive drum 15.

The photosensitive drum 15 is supported by the cartridge shell 14 of the process cartridge 13 in such a manner that the side in contact with the primary charging means 17 (charging roller 17*a*) and the cleaning blade 16 remains in the cartridge shell 14, whereas the side which is to be exposed to an image forming beam, or comes in contact with the developing means 20 and 21 and the intermediary transfer member 9 is exposed from the cartridge shell 14. This exposed portion of the photosensitive drum 15 is rather large, constituting approximately one half of the photosensitive drum 15; the cross-section of the exposed portion is shaped like a half moon. More specifically, the portion of the photosensitive drum, which is exposed when the process cartridge 13 is in the apparatus main assembly 50, is constituted of a portion 15*a* where the information carrying light emitted from a scanning section 30 provided in the apparatus main assembly is received by the photosensitive member 15, a portion 15*b* where a latent image formed on the photosensitive drum 15 is developed, and a portion 15*c* where a toner image formed on the photosensitive drum 15 is transferred onto the intermediary transfer medium 9.

The process cartridge 13 is provided with a first shutter member 51 and a second shutter member 52. When the process cartridge 13 is out of the main assembly 50, the first and second shutter members 51 and 52 cover the opening of the cartridge shell 14 to protect the portions of the photosensitive drum 15, which are exposed from the cartridge shell 14. In this embodiment, the cartridge shell 14 constitutes a cartridge frame, but the cartridge structure is not limited to the one described in this embodiment.

(Charging Means)

As the charging means 17, a contact type charging means is employed. In this means, an electrically conductive charging roller 17*b* is placed in contact with the photosensitive drum 15, and the surface of the photosensitive drum 15 is uniformly charged by applying a predetermined voltage to the electrically conductive charging roller 17*b*.

(Exposing Means)

The photosensitive drum 15 is exposed by a scanner section 30. More specifically, as an image signal is given to a laser diode, the laser diode emits light in response to the image signal, and this light (image forming light), which carries image data, is projected toward a polygon mirror 31, which is being rotated at a high speed by a scanner motor, and is deflected by the polygon mirror. The deflected image forming light is further projected through an image forming lens 32 and a deflection mirror 33 to selectively expose the peripheral surface of the photosensitive drum 15 which is being rotated at a predetermined fixed speed. As a result, an electrostatic latent image is formed on the photosensitive drum 15.

(Developing Means)

The developing means comprises developing means 20 and 21, and visualizes the electrostatic latent image. The developing means 20 has three color developing devices 20Y, 20M and 20C, which develop yellow color, magenta color and cyan color, correspondingly. The developing means 21 has a black color developing device 21B.

The black color developing device 21B is a stationary developing device, and forms a visual image of black toner on the photosensitive drum. It is disposed in such a manner that a microscopic gap (approximately 300 μm) is maintained between the peripheral surfaces of the developing roller 21BS and photosensitive drum 15.

In the black color developing device 21B, a coating blade 21BB is placed in contact with the peripheral surface of the developing roller 21BS, with a predetermined contact pressure. As the toner within the container is fed toward the developing roller 21BS by a toner feeding mechanism, the coating blade 21BB coats a thin layer of the toner on the peripheral surface of the developing roller 21BS which is being rotated in the clockwise direction. While coating the toner, the coating blade 21BB triboelectrically charges the toner. As a development bias is applied to the developing roller 21BS, the electrostatic latent image on the photosensitive drum 15 is developed by the toner.

Each of the three color developing devices 20Y, 20M and 20C is removably supported by a developing device rotary 23 which is rotatable about an axis 22. In image formation, the color developing devices 20Y, 20M and 20C, being supported by the developing device rotary 23, are rotated about the axis 22 in order to align one of the color developing devices 20Y, 20M and 20C with the photosensitive drum 15 in such a manner that its developing roller is positioned to hold a microscopic gap (approximately 300 μm) from the photosensitive drum 15. With this arrangement, a visual color toner image is formed on the photosensitive drum 15 in correspondence to the electrostatic latent image thereon. During color image formation, the development device rotary 23 is rotated by a predetermined angle per full rotation of the intermediary transfer member 9 to sequentially align the yellow developing device 20Y, the magenta developing device 20M, and the cyan developing device 20C, with the photosensitive member 14 to develop the yellow, magenta, and cyan color, and thereafter, the black color is developed by the black color developing device 20B.

In FIG. 1, the yellow color developing device 20Y is in alignment with the photosensitive drum 15. In the color developing device 20Y, a developing blade 20YB is placed in contact with the peripheral surface of a developing roller 20YS, with a predetermined contact pressure. As the toner within the container is fed toward a coating roller 20YR by a toner feeding mechanism, the coating roller 20YR, which is being rotated in the clockwise direction, and the developing blade 20YB, coat a thin layer of the toner on the peripheral surface of the developing roller 20YS which is being rotated in the clockwise direction. While being coated on the developing roller 20YS, the toner is triboelectrically charged. As a developing bias is applied to the developing roller 20YS which is in alignment with the photosensitive drum 1 on which a latent image has been formed, a toner image develops on the photosensitive drum 15 in correspondence with the latent image. Also in the magenta color developing device 20M and the cyan color developing device 20C, a toner image is developed through the same mechanism as the one described above.

As the color developing devices 20Y, 20M and 20C are rotated to the latent image developing position, the developing roller of each color developing device is connected to a high voltage power source provided in the apparatus main assembly 50, whereby a predetermined voltage is selectively and sequentially applied to each developing device.

(Intermediary Transfer Member)

During the formation of a single color image, the intermediary transfer member 9 receives a toner image four times from the photosensitive drum 15, in the superimposing manner; it receives four color toner images (yellow Y, magenta M, cyan C, and black Bk images) which are formed (visualized) on the photosensitive drum 15 by the developing devices 20Y, 20M, 20C and 20B. It is rotated in synchronism with the peripheral velocity of the photosensitive drum 15 in the clockwise direction indicated in the drawing. After the intermediary transfer member 9 receives four toner images in the superimposing manner, a transfer material 2 is sent in, and is conveyed between the intermediary transfer member 9 and a transfer roller 10, being pinched by them. While the transfer material is conveyed between the intermediary transfer member 9 and the transfer roller 10, a voltage is applied to the transfer roller 10, whereby the color toner images on the intermediary transfer member 9 are transferred all at once onto the transfer material 2 in the superimposing manner.

The intermediary transfer member 9 in this embodiment comprises an aluminum cylinder 12 having a diameter of 180 mm, and an elastic layer 11 which covers the peripheral surface of the aluminum cylinder 12. The elastic layer 11 is formed of sponge, rubber, or the like, which has intermediate resistance. The intermediary transfer member 9 is rotatively supported, and rotates as it receives driving force by a gear (unillustrated) integrally fixed to the intermediary transfer member 9.

(Cleaning Means)

Cleaning means cleans the toner which remains on the photosensitive drum 15 after the visual image (toner image) formed on the photosensitive drum 15 by the developing means is transferred onto the intermediary transfer member 9; the residual toner is cleaned by the cleaning blade 16 which is placed in contact with the photosensitive drum 15 with a predetermined contact pressure. The waste toner removed from the photosensitive drum 15 is collected in the cartridge shell 14. The amount of the waste toner which is removed from the photosensitive drum 15 and collected in the cartridge shell 14 is not large enough to fill up the cartridge shell 14 before the service life of the photosensitive drum 15 expires. Therefore, the collected waste toner is disposed together with the cartridge shell 14 which contains the expired photosensitive drum 15.

(Sheet Feeding Section)

A sheet feeding section feeds the transfer material 2 into an image forming section. It is primarily constituted of a sheet feeding cassette 1, a sheet feeding roller 3, a retarding roller 5, a sheet feeding guide 6, and a registration roller 8. The sheet feeding cassette 1 holds plural sheets of the transfer material 2, and the retarding roller 5 prevents the transfer material 2 from being fed by two or more. During image formation, the sheet feeding roller 3 is rotatively driven in coordination with an image forming operation. As the sheet feeding roller 3 is driven, the transfer materials 2 in the sheet feeding cassette 1 are separated, fed out one by one from the sheet feeding cassette 1. The transfer material 2 having been fed out of the sheet feeding cassette 1 is guided by the sheet guide 6, and is delivered to the registration roller 3 by way of a conveyer roller 7. Also during image formation, the registration roller 8 carries out a nonrotational operation and a rotational operation in a predetermined sequence, wherein the nonrotational operation keeps the transfer material 2 on standby, and the rotational operation conveys the transfer material 2 toward the intermediary transfer material 9. Though this sequence, the image on the intermediary transfer member 9, and the transfer material 2, are aligned for the following step, that is, a transferring step.

(Transferring Section)

The transferring section is constituted of an oscillatable transferring roller 10.

The transferring roller 10 comprises a metallic shaft, and a foamed elastic material wrapped around the metallic shaft. The foamed elastic material has intermediate resistance. The transferring roller 10 is vertically movable, and also is rotatable. While four color images are transferred onto the intermediary transfer member 9, that is, while the intermediary transfer member 9 rotates a predetermined number of times, the transferring roller 10 is positioned below the intermediary transfer member 9, being away from the intermediary transfer member 9 as indicated by a solid line. After the transfer of the four color toner images onto the intermediary transfer member 9, the transferring roller 10 is moved by an unillustrated cam member upward to the position indicated by a fine line, in synchronism with the timing for transferring the color images onto the transfer material 2. Consequently, the transferring roller 10 is pressed against the intermediary transfer member 9 and generates a predetermined contact pressure, with the transfer material being pinched between the transferring roller 10 and the intermediary transfer member 9. In this state, a bias is applied to the transferring roller 10, whereby the toner image on the intermediary transfer member 9 is transferred onto the transfer material 2. Since the intermediary transfer member 9 and the transferring roller 10 are both driven, the transfer material 2 pinched by the two is conveyed toward a fixing section 25 for the next step, while the transferring operation is carried out.

(Fixing Section)

The fixing section 25 fixes to the transfer material 2, the toner image which has been formed by the aforementioned developing means 20 and 21, and has been transferred onto the transfer material 2 by way of the intermediary transfer member 9. As illustrated in FIG. 1, the fixing section 25 comprises a fixing roller 26 which applies heat to the transfer material 2, and a pressuring roller 27 which presses the transfer material 2 upon the fixing roller 26. Both rollers are hollow, containing heaters 28 and 29, respectively, and are rotatively driven to convey the transfer material 2 while performing a fixing operation.

More specifically, while the transfer material 2 carrying a toner image is conveyed by the fixing roller 26 and the pressuring roller 27, heat and pressure are applied to the transfer material 2. As a result, the toner image is fixed to the transfer material 2.

(2) Drum Shutter Structure

Next, referring to FIGS. 3–7, the structure of the drum shutter of the process cartridge 13 will be described. The drum shutter comprises a first shutter member 51 and a second shutter member 52.

Figure 3:
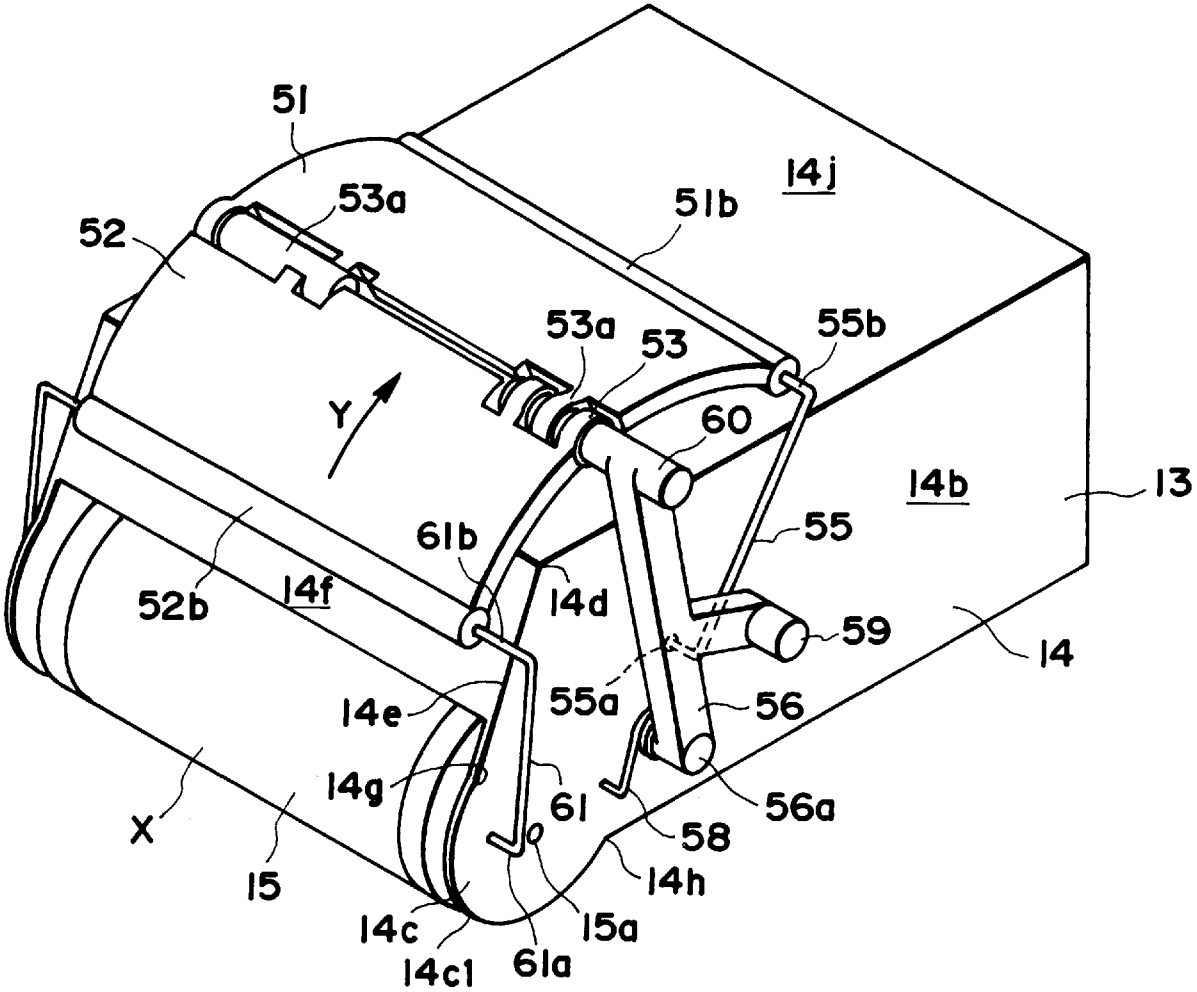
FIG. 3 is a perspective view of the process cartridge in the first embodiment of the present invention.
Figure 4:
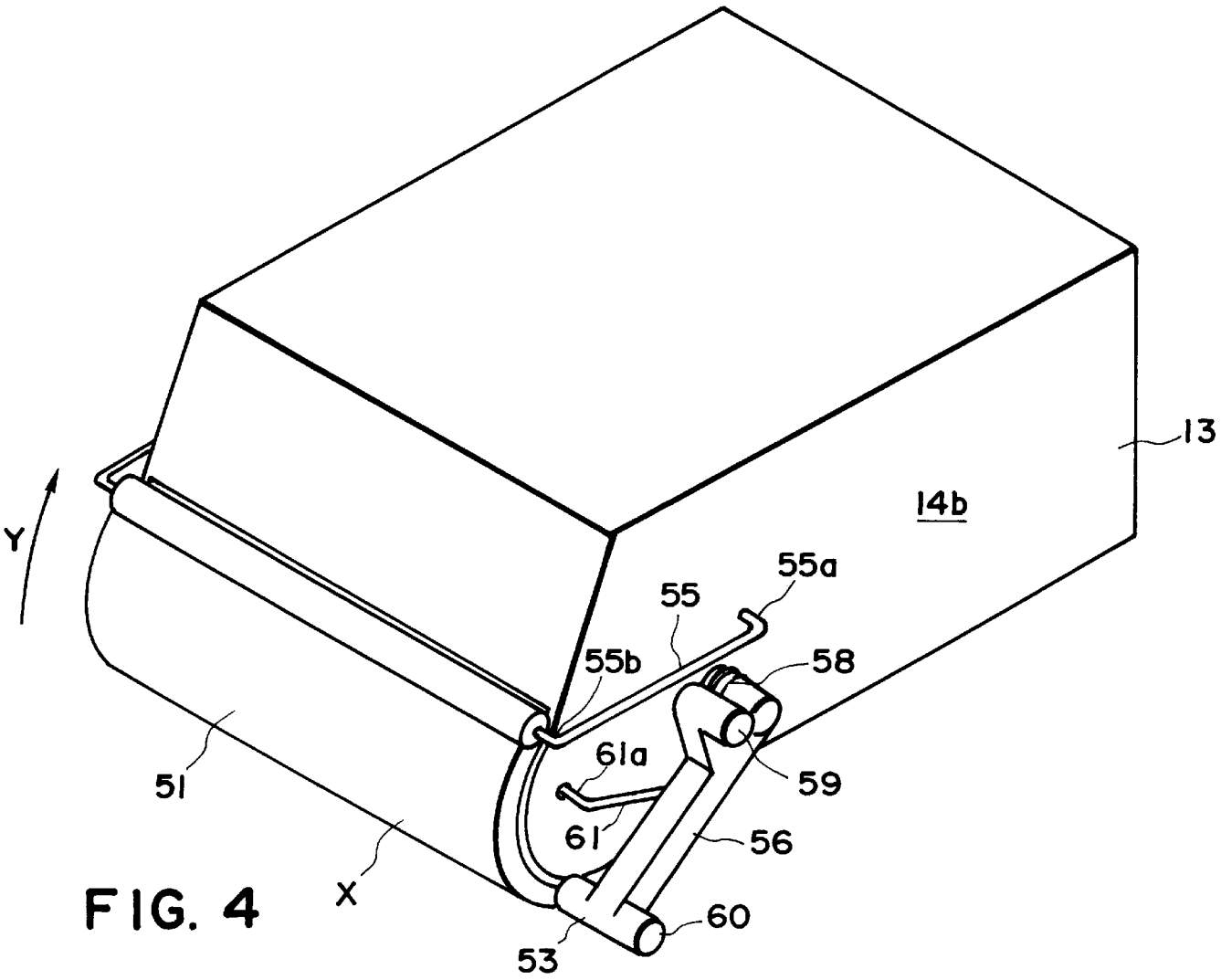
FIG. 4 is also a perspective view of the process cartridge in the first embodiment of the present invention.
Figure 5:
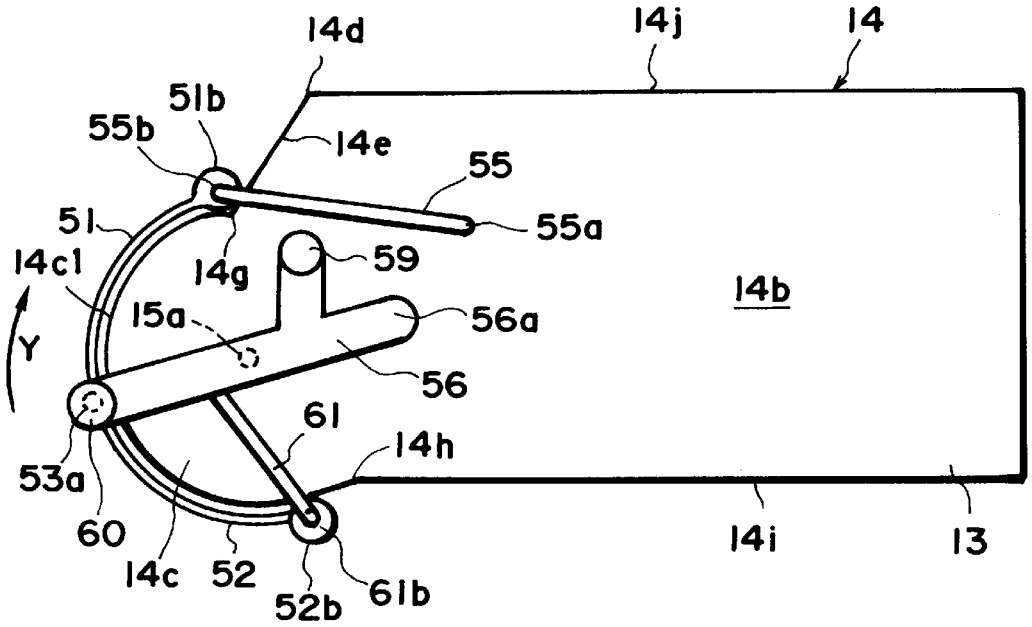
FIG. 5 is a side view of the process cartridge in the first embodiment of the present invention.
Figure 6:
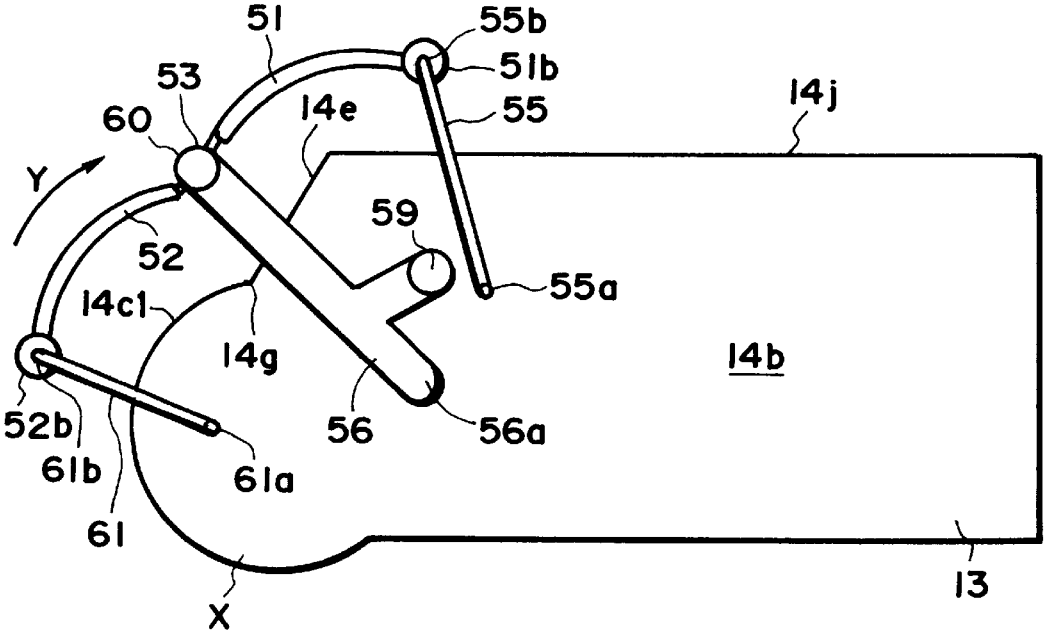
FIG. 6 is also a side view of the process cartridge in the first embodiment of the present invention.
Figure 7:
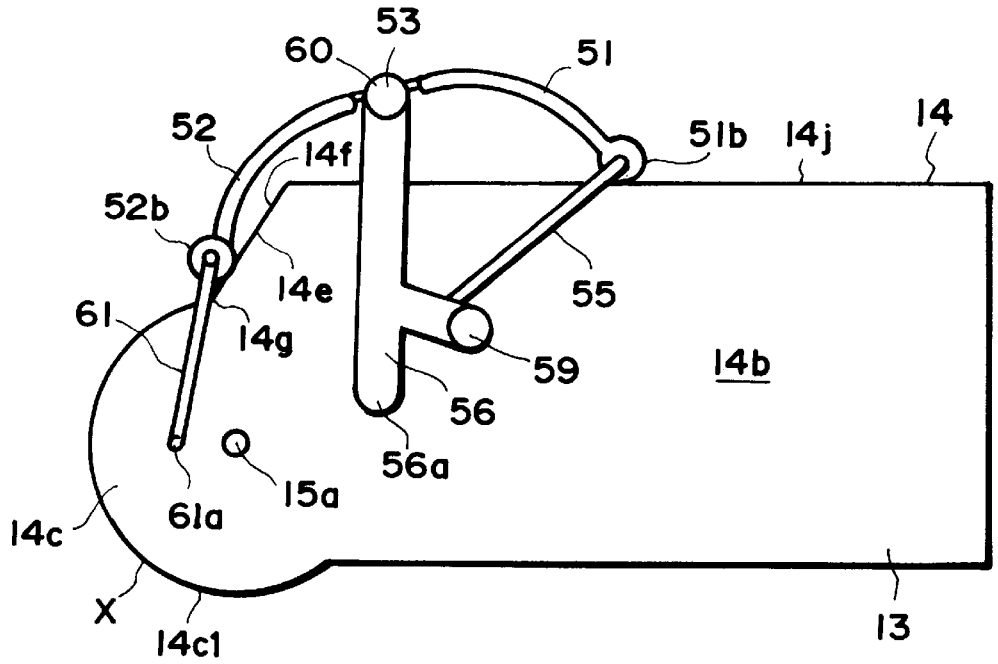
FIG. 7 is also a side view of the process cartridge in the first embodiment of the present invention.

FIG. 3 is a perspective view of the drum shutter (51, 52) which is open, and FIG. 4 is a perspective view of the drum shutter (51, 52) which is closed. FIG. 5 is a side view of the drum shutter (51, 52) which is closed, and FIG. 6 is a side view of the drum shutter (51, 52) which is half open. FIG. 7 is a side view of the drum shutter (51, 52) which is fully open.

Referring to FIG. 3, the cartridge shell 14 is substantially a hollow container except for a drum supporting section 14*c* which supports the photosensitive drum 15. It is structured to expose the peripheral surface of the photosensitive drum 15, on the top left side, bottom left side, and bottom right side, as seen from the front side of FIG. 3. The top left side of the peripheral surface of the photosensitive drum 15 is exposed to allow it to be exposed to the image forming light as well as to allow it to access the black developing means 21, and the bottom left side is exposed to allow it to access the color developing means 20. The bottom right side is exposed to allow it to access the intermediary transfer member 9. These top left, bottom left, and bottom right sides of the peripheral surface of the photosensitive member 15, are exposed for the developing means 20 and 21 and the intermediary transfer member 9, correspondingly, and continuous. Further, the bottom left side of the cartridge shell 14 as seen from the front side of FIG. 3 is open, and the side plate 14*b* of the cartridge shell 14 is extended in the bottom left direction, forming a drum supporting portion which supports a drum axis 15*a* to rotatively support the photosensitive drum 15. The drum supporting portion 14*c* is constituted of a semicircular portion 14*c*1 having substantially the same radius as the photosensitive drum 15, wherein the drum axis 15*a* is positioned at the center of this semicircular portion 14*c*1. The top left corner 14*d* of the side plate 14*b* and the semicircular portion 14*c*1 is connected with a straight portion 14*e*, which is where the front plate 14*f* (FIG. 3) of the cartridge shell 14 and the side plate 14*b* of the cartridge shell 14 meet. The front plate 14*f* must be such a plate that allows the top left side of the peripheral surface of the photosensitive drum 15, as seen from the front side of FIG. 3, to be exposed to the image forming light, does not interfere with the black developing means 21B, allows the primary charging means 17 to be housed within the cartridge shell 14, and does not intersect with the locus of the drum shutter (51, 52). Therefore, the distance from the drum axis 15*a* to the top left corner 14*d* of the side plate 14*b* must be substantially greater than the radius of the photosensitive drum 15, which is obvious.

In the case of the above described process cartridge 13, as the drum shutter (51, 52) is opened or closed, the locus of the drum shutter (51, 52) closely follows the photosensitive drum 15, and then, the cartridge shell 14. In other words, according to this embodiment, the drum shutter (51, 52) can be opened or closed in a manner to closely follow the exterior surface of the cartridge shell 14.

Next, the drum shutter (51, 52) which is movable to expose or cover the opening of the cartridge shell 14, through which the photosensitive drum 15 is exposed, will be described.

As described previously, the drum shutter (51, 52) comprises the first and second shutter members 51 and 52 which are separate from each other. They are in the form of a plate having an arc-like cross-section which conforms to the contour of the peripheral surface of the photosensitive member 15. As seen from the toner side of FIG. 3, the combined length of the first and second shutter members 51 and 52 matches the length of the portion of the peripheral surface of the photosensitive drum 15, which is exposed from the cartridge shell 14.

Referring to FIG. 3, the first and second shutter member 51 and 52 are hinged together, being allowed to pivot about a hinged portion 53. More specifically, the hinged portion 53 comprises knuckles and a pivot pin 53*a*. The pivot pin 53*a* is inserted through the aligned knuckles in the direction parallel to the longitudinal direction of the photosensitive drum 15.

The pivot pin 53*a* is integrally formed with a hinge supporting lever 56, extending from the free end of the hinge supporting lever 56 (hinge supporting lever 56 may be provided on both sides of the cartridge shell 14). The hinge supporting lever 56 has a central axis 56*a* which is parallel to the pivot pin 53*a*. The central axis 56*a* is rotatively supported by the side plate 14*b* of the cartridge shell 14, and is fitted with a torsional coil spring 58. The one end of the torsional coil spring 58 is anchored to the central axis 56*a*, and the other end is anchored to the side plate 14*b*. Therefore, the torsional coil spring pressures the hinge supporting lever 56 to rotate in the closing direction of the drum shutter (51, 52) (direction to cover the photosensitive drum 15). The hinge supporting lever 56 has two projections (driving members) 59 and 60 for opening the drum shutter. More specifically, when the process cartridge 13 is installed into the apparatus main assembly 50, these projection 59 and 60 come in contact with stationary contact members (unillustrated), respectively, causing thereby the hinge supporting lever 56 to be rotated against the force of the torsional coil spring 58 in the direction to move the drum shutter (51, 52) away from the surface of the photosensitive drum 15 so that the photosensitive drum 15 is exposed to the developing means 20 and 21 and the intermediary transfer member 9. The projection 59 is located at the end of an arm which branches out of the center portion of the hinge supporting member 56 in the direction opposite to the photosensitive drum 15, and the other projection 60 is rendered coaxial with the pivot pin 53*a*. The first shutter member 51 is supported by a first lever member 55 as an end supporting lever, and the aforementioned hinge supporting lever 56. The one end of the first lever member 55 forms a rotational axis 55*a* which is parallel to the photosensitive member 15, and the other end forms pin portion 55*b* which is also parallel to the photosensitive member 15. The first lever member 55 is attached to the side plate 14*b* of the cartridge shell 14, by the rotational axis 55*a*, at a point which is on the opposite side of the central axis 56*a* of the hinge supporting lever 56 as seen from the photosensitive drum 15. The pin portion 55*b* is fitted to the first shutter member 51, at an end portion 51*b* which is located on the side opposite to the hinged portion 53. Thus, the side plate 14*b* of the cartridge shell 14, the first lever member 55, the first shutter member 51, and the hinge supporting lever 56 are linked together, forming a rotational four joint linkage mechanism.

The second shutter member 52 is supported by a second lever member 61 as an end supporting lever, and the aforementioned hinge supporting lever 56. One end of the second lever member 61 forms a rotational axis 61*a* which is parallel to the photosensitive member 15, and the other end forms a pin portion 61*b* which also is parallel to the photosensitive drum 15. The second lever member 61 is attached to the drum supporting portion 14*c*, that is, the extension of the side plate 14*b* of the cartridge shell 14, by the rotational axis 61*a*, at a point which is on the same side of the central axis 56*a* as seen from the side of the photosensitive member 15. The pin portion 61*b* is fitted to the second shutter member 52, at an end portion 52*b* which is located on the side opposite to the hinged portion 53. Thus, the side plate 14*b* of the cartridge shell 14, the second lever member 61, the second shutter member 52, and the hinge supporting lever 56 are linked together, forming a rotational four joint linkage mechanism. As is evident from the above description, the rotational four joint linkage mechanism for moving the first shutter member 51, and the rotational four joint linkage mechanism for moving the second shutter member 52, share the hinge supporting lever 56.

Referring to FIG. 5, when the drum shutter (51, 52) is in the closed state, the pin portion 55*b* of the first lever member 55, the pin portion 61*b* of the second lever member 61, and the pivot pin 53*a* located at the end of the hinge supporting lever 56, are positioned along the peripheral surface of the photosensitive member 15. More specifically, the pin portion 55*b* of the first lever member 55 (end portion 51*b* of the first shutter member 51) is positioned near a joint portion 14*g* where the semicircular portion 14*c*1 of the drum supporting portion 14*c* meets the straight portion 14*e*, and the pin portion 61*b* of the second lever member 61 (end portion 52*b* of the second shutter member 52) is positioned near a corner portion 14*h* where the semicircular portion 14*c*1 of the drum supporting portion 14*c* meets the bottom plate 14*i* of the cartridge shell 14. The length of the aforementioned first lever member 55, the position of the rotational axis 55*a*, the length of the second lever member 61, the position of the rotational axis 61*a*, the length of the hinge supporting lever 56, and the position of the rotational axis 56*a*, are determined so that the drum shutter can be moved from the closed position to the open position without allowing it to interfere with the cartridge shell 14 and the photosensitive drum 15 while keeping it as close as possible to the photosensitive drum 15 and the cartridge shell 14.

More specifically, the pin portion 55*b* of the first lever member 55 (end portion 51*b* of the first shutter member 51) and the hinge portion 53 located at one end of the hinge supporting member 56 must clear the edge (straight line which is perpendicular to the surface of the page containing FIG. 5, and runs through the corner 14*d*) where the front plate 14*f* of the cartridge shell 14 meets the top plate 14*j*. Further, when the drum shutter (51, 52) is opened, the end portion 51*b* of the first shutter member 51 (position of the pin portion 55*b*) must be prevented from contacting the top plate 14*j* of the cartridge shell 14 before the end portion 52*b* of the second shutter member 52 moves away from the peripheral surface of the photosensitive member 15 and comes close to the joint portion 14*g* of the straight portion 14*e* and the semicircular portion 14*c*1.

Next, the operation of the drum shutter (51, 52) will be described.

Referring to FIG. 2, a cover 70*a* covers a cartridge entrance 70 provided in the external wall of the apparatus main assembly 50. As the cover 70*a* is outwardly opened about a hinge 70*b*, attached to the apparatus main assembly 50, guide members (unillustrated) are exposed, one being on the left side and the other being on the right side. They extend inward from the entrance 70. When the process cartridge 13 is inserted, it is rested on these guide members, and is caused to slide thereon in the direction of an arrow mark Z, being moved from a position D indicated in FIG. 2 to the predetermined position indicated in FIG. 1, past a position E indicated in FIG. 2. Then, it is fixedly positioned at the position indicated in FIG. 1. When the process cartridge 13 is out of the apparatus main assembly 50, the drum shutter (51, 52) covers the photosensitive drum 15 as shown in FIGS. 2, 4 and 5. As the process cartridge 13 is advanced from the cartridge entrance 70 into the apparatus main assembly 50 as described above, the projections 59 and 60, which are provided on the hinge supporting lever 56 to open or close the shutter members, are pushed by unillustrated guide portions provided on the internal wall of the apparatus main assembly 50. Therefore, the hinge supporting lever 56 is rotated in the clockwise direction about the central axis 56*a* from the position illustrated in FIG. 5 against the force of the torsional coil spring 58, and the hinge portion 53 is rotated about the central axis 56 of the hinge supporting lever 56. As the hinge portion 53 is rotated, it pushes the first shutter member 51, and then, the first pin portion 55*b* causes the first lever member 55 to rotate in the clockwise direction about the rotational axis 55*a*. Further, as the hinge portion 53 is rotated, it pulls the second shutter member 52, and then, the second pin portion 61*b* causes the second lever member 61 to rotate in the clockwise direction about the rotational axis 61*a*. Therefore, the first lever member 55, the hinge supporting lever 56, and the second lever member 61 rotate in the same direction, causing the first shutter member 51 and the second shutter member 52 to move in the clockwise direction, along the peripheral surface of the photosensitive member 15, in a manner to gradually move away from the peripheral surface of the photosensitive member 15, past the position illustrated in FIG. 6. Referring to FIG. 7, as the end portion 51*b* of the first shutter member, which is supported by the first lever member 55, comes close to the top plate 14*j* of the cartridge shell 14, and the end portion 52*b* of the second shutter member 52, which is supported by the second lever member 61, comes close to the front plate 14*j*, and the joint portion 14*g* between the semicircular portion 14*c*1 of the drum supporting portion 14*c* and the straight portion 14*e* of the front plate 14*f*, the unillustrated guide of the apparatus main assembly 50, which guides the shutter opening/closing projections 59 and 60, prevents the projections 59 and 60 from moving further. Therefore, the drum shutter (51, 52) stops at this position. Then, with the drum shutter (51, 52) maintaining the above described open position, the process cartridge 13 is advanced further into the apparatus main assembly 50, and is set at the predetermined position where the developing means 20 and 21, the intermediary transfer member 9, and the exposing means (scanner section 30) can act on the photosensitive member 15.

In the state illustrated in FIG. 7, the portion of the photosensitive member 15, which must be exposed from the cartridge shell 14, is fully exposed, and the first and second shutter members 51 and 52 are positioned along the top surface of the cartridge shell 14. Therefore, the size of the space through which the process cartridge 13 is inserted into the apparatus main assembly 50 may be relatively small.

In order to remove the process cartridge in the state illustrated in FIG. 1, first, the cover 70*a* is opened outwardly about the hinge 70*b*, and the process cartridge 13 is to be pulled out by grasping it with a hand inserted through the cartridge entrance 70. As the process cartridge 13 is pulled, it comes out toward the cartridge entrance 70. Up to a certain point, it is guided by the unillustrated guide member, with the drum shutter (51, 52) being fully open as shown in FIGS. 3 and 7. During this movement of the process cartridge 13, the shutter opening/closing projections 59 and 60 are guided by the unillustrated guide member provided on the internal surface of the apparatus main assembly 50, allowing the drum shutter (51, 52) to remain in the fully open state as shown in FIGS. 3 and 7. As the process cartridge 13 is pulled out further toward the cartridge entrance 70, the guide member controls the projections 59 and 60 in such a manner that the hinge supporting lever 56 is rotated about the central axis 56*a*, with the rotational angle being regulated in coordination with the position of the process cartridge 13, against the force of the torsional coil spring 58 which pressures the hinge supporting lever 56 in the counterclockwise direction in FIGS. 3 and 7. As a result, the first and second lever members 55 and 61 are rotated in the counterclockwise direction, causing the first and second shutter members 51 and 52 to move in the closing direction; the first and second shutter members 51 and 52 go through the stage illustrated in FIG. 6, rotate further as illustrated in FIGS. 4 and 5, and finally covers the portion of the photosensitive member 15, which has been exposed. After going through the stage illustrated in FIGS. 4 and 5, the process cartridge 13 becomes disengaged from the unillustrated guide member of the apparatus main assembly 50, and then is moved out of the apparatus main assembly 50 through the cartridge entrance 70. When the process cartridge 13 is out of the apparatus main assembly 50, the first and second shutter members 51 and 52 remain in the closed state due to the presence of the force of the torsional coil spring 58 which pressures the hinge supporting lever 56 in the direction to close the drum shutter.

In this first embodiment, the rotational axis 61*a* of the second lever member 61 may be rendered coaxial with the drum axis 15*a*. With this arrangement, the end portion 52*a* of the second shutter member 52, which is supported by the second lever member 61, moves along the photosensitive member 15; in FIG. 5, the end portion 52*b* of the second shutter member 52, to which the pin portion 61*b* is fitted, moves along the photosensitive member 15. In other words, the locus of the second shutter member 52 runs only slightly above the imaginary contour formed by adding the thickness of the end portion 61*b* to the contour of the peripheral surface of the photosensitive member 15. Therefore, it is possible to reduce the size of the space which is necessary in front and below the photosensitive drum 15 to allow the drum shutter (51, 52) to move.

According to the above description, the projections 59 and 60 for opening or closing the drum shutter are provided on the process cartridge 13 side, and the unillustrated guide members for guiding the projection 59 and 60 to automatically open or close the first and second shutter members 51 and 52 are provided on the apparatus main assembly 50 side. Therefore, it is unnecessary to manually open or close the drum shutter (51, 52) when inserting the process cartridge 13 into the apparatus main assembly 50, or removing it therefrom. This is very desirable for operational efficiency.

For the simplification of the process cartridge structure, the projections 59 and 60 for opening or closing the drum shutter (51, 52) may be eliminated together with the unillustrated guide members provided on the apparatus main assembly 50 to guide the projections 59 and 60, and instead, the process cartridge may be provided with holding means, for example, a notch, for keeping the drum shutter (51, 52) in the fully open state. In such a case, the drum shutter (51, 52) is to be manually opened and kept in the fully open state by the holding means when inserting the process cartridge 13 into the apparatus main assembly 50, and is to be manually closed after removing the process cartridge 13 from the apparatus main assembly 50.

Embodiment 2

Figure 8:
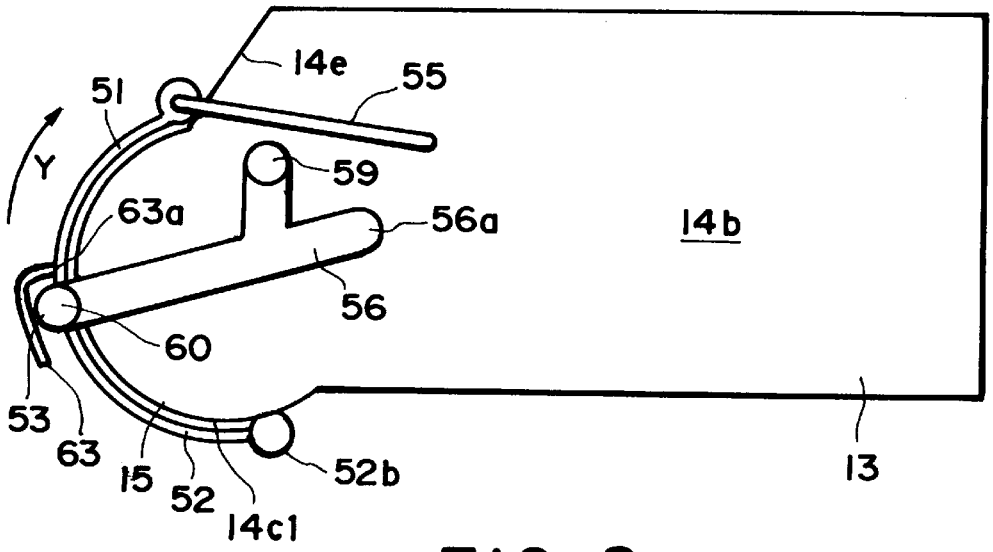
FIG. 8 is a side view of the process cartridge in the second embodiment of the present invention.
Figure 9:
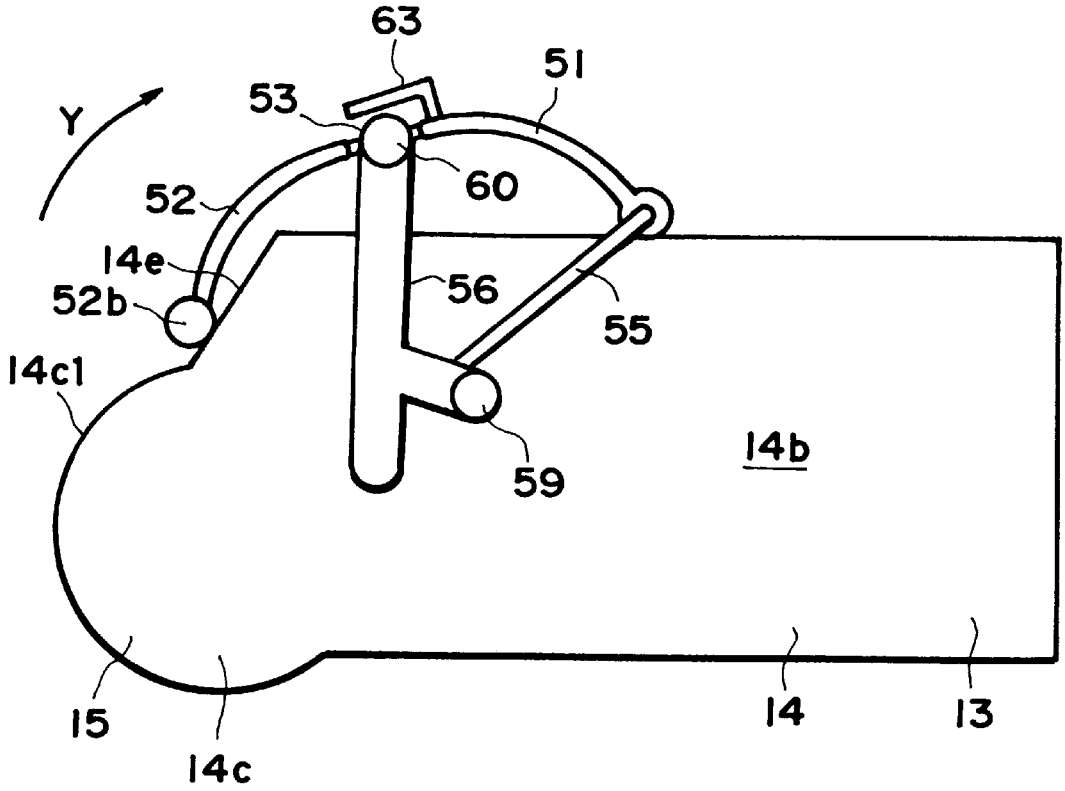
FIG. 9 is also a side view of the process cartridge in the second embodiment of the present invention.
Figure 10:
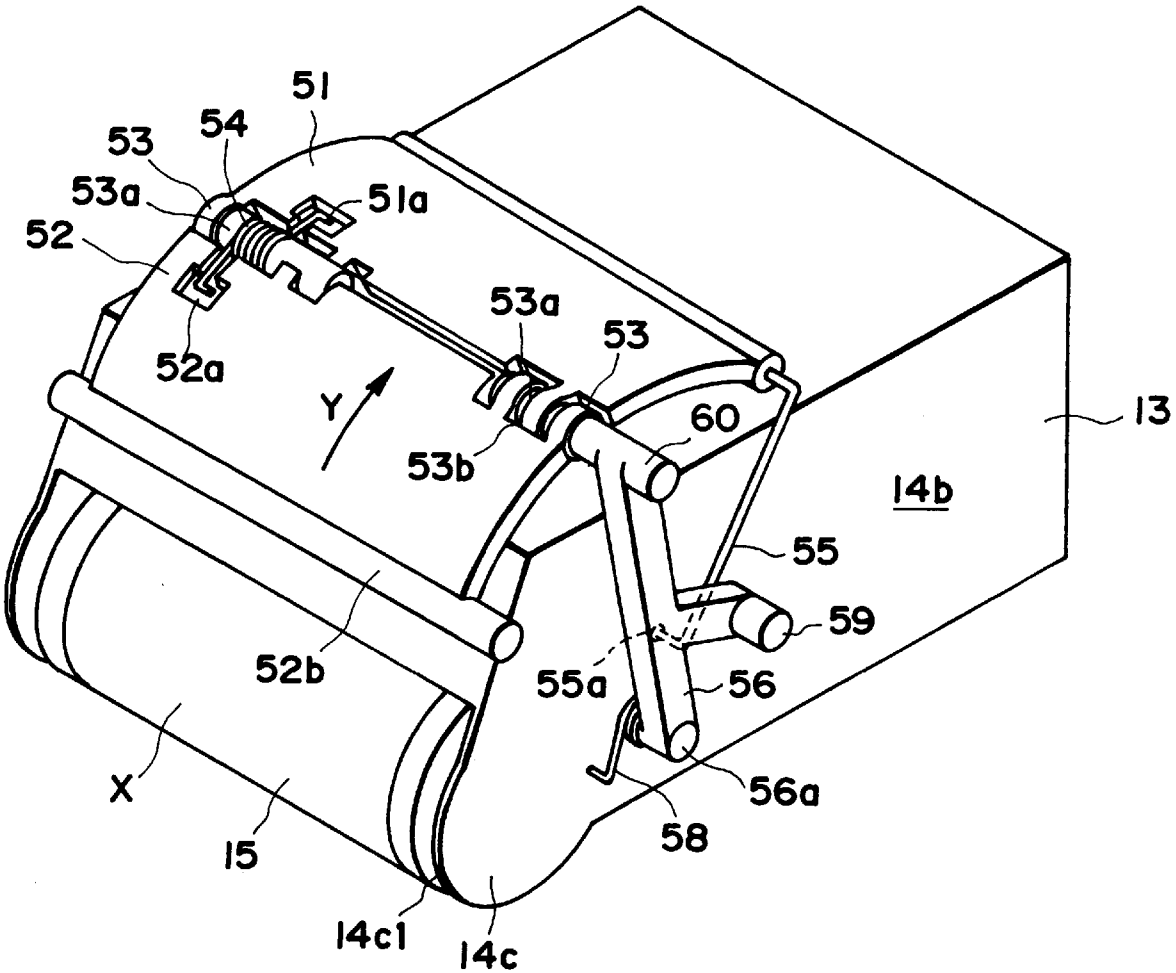
FIG. 10 is a perspective view of the process cartridge in the second embodiment of the present invention.

FIGS. 8, 9 and 10 show another embodiment of the present invention, in which the drum shutter is also constituted of two separate pieces.

In this second embodiment, the first shutter member 51 is supported in the same manner as the first embodiment. However, the second shutter member 52 is supported by the hinge supporting lever 56 alone; the second shutter member 52 is supported at only one of the end portions (end portion relative to the direction perpendicular to the opening/closing direction of the shutter member). Further, a torsional coil spring is fitted around the pivot pin 53*a*, one end being anchored to the spring anchoring portion 51*a* of the first shutter member 51, and the other end being anchored to the spring anchoring portion 52*a* of the second shutter member 52, pressuring thereby the second shutter member 52 in such a manner that the surface of the second shutter member 52, which is facing the photosensitive member 15, is moved toward the internal surface side of the first shutter member 51.

The first lever member 55 and the hinge lever 56 are attached to the side plate 14*b* of the cartridge shell 14 as they are in the first embodiment.

The first shutter member 51 is connected to the second shutter member 52 at both lateral ends by the hinge portions 53 and 53*b,* respectively. The first lever member 55 for regulating the rotational locus of the drum shutter (51, 52) is attached to the leading end, relative to the opening direction (Y direction in FIG. 10), of the first shutter member 51, at both lateral ends. The hinge supporting lever 56 is attached to the trailing end of the first shutter member 51. This arrangement regulates the loci of both ends of the first shutter member 51, and one end of the second shutter member 52 (hinge portion 53*b*). The second shutter member 52 is pressured in the counterclockwise direction by the torsional coil spring 54 provided in the hinge portion 53 as shown in FIG. 10, and the end portion 52*b,* which is opposite to the hinge portion 53, remains in contact with the semicircular portion 14*c*1 of the drum supporting portion 14*c* as shown in FIG. 8.

The first lever member 55 is formed of a metallic rod, one end being bent to form a rotational axis 55*a* which is parallel to the photosensitive drum 14. The first lever member 55 is attached to the side plate 14*b* of the cartridge shell 14 by the rotational axis 55*a*, at a point which is on the other side of the central axis 56*a* of the hinge supporting lever, 56 as seen from the photosensitive drum 14 side. The hinge supporting lever 56 is integrally formed with the pivot pin 53*a,* and is attached to the side plate 14*b* of the cartridge shell 14 by the central axis 56*a* which is parallel to the photosensitive drum 14. To the pivot pin 53*a,* the first and second shutter member 51 and 52 are rotatively attached.

The rotational locus of the end portion 52*b* of the second shutter member 52 (end portion which is opposite to the end supported by the hinge supporting lever 56) is regulated by the aforementioned torsional coil spring 54. Therefore, the rotational locus of the drum shutter (51, 52) is rendered compact as will be described below.

Referring to FIG. 8, as the hinge supporting lever 56 is rotated about the central axis 56*a* in the clockwise direction against the force of the torsional coil spring 58 (FIGS. 3 and 10) fitted around the central axis 56*a,* the first shutter member 51 is opened in the same manner as it is in the first embodiment. However, the second shutter member 52 is moved, with its end portion 52*b* remaining in contact with the semicircular portion 14*c*1 of the drum supporting portion 14*c*. During this movement of the second shutter member 52, when the second shutter member 52 is on the under side of the semicircular portion 14*c*1, the force of the torsional coil spring 54 keeps the end portion 52 of the second shutter member 52 in contact with the semicircular portion 14*c*1, against the self weight of the second shutter member 52, and when the second shutter member 52 is on the upper side of the semicircular portion 14*c*1 or on the straight portion 14*e,* the end portion 52*b* is pressed upon them by the self weight of the second shutter member 52 as well as the force of the torsional spring 54.

FIG. 9 shows the open drum shutter (51, 52). While the drum shutter (51, 52) is moving from the closed position to the open position, the end portion 52*b* of the second shutter member 52 moves in contact with the semicircular portion 14*c*1 or the straight portion 14*e*. Therefore, the size of the space which the locus of the drum shutter (51, 52) occupies is small, in particular, on the under side of the photosensitive drum 14. With the arrangement of this second embodiment, even though the number of the shutter members remains to be two, the number of the level members decreases to two. Therefore, overall component count becomes smaller.

Further, a stopper 63 for regulating the rotation of the second shutter member 52 may be disposed adjacent to the hinge portion 53, to prevent the second shutter member 52 from being excessively rotated in the reverse direction. With this arrangement, it is possible to prevent the second shutter member (51, 52), which is closed as illustrated in FIG. 8, from being inadvertently opened widely by hand.

This stopper 63 may be integrally formed with the first shutter member 51, or may be separately formed and fixed to the first shutter member 51 by the base portion 63*a*. It is in the form of a key, and extends over the hinge portion 53 to partially cover the second shutter member 52. When the drum shutter (51, 52) is in the closed state, the tip of the stopper 63 makes contact with the second shutter member 52, so that when the drum shutter (51, 52) is opened, the first and second shutter member 52 are allowed to rotate away from the cartridge shell 14 about the hinge portion 53.

In this embodiment, the first lever member is formed of a metallic rod, and is attached to the first shutter member 51 in manner to straddle it in the direction perpendicular to the opening direction of the drum shutter (51, 52). One end of the aforementioned metallic rod is rotatively attached to the side plate 14*b* of the cartridge shell 14, and the other end is rotatively attached to the other side of the cartridge shell 14.

As the process cartridge 13 is inserted into the cartridge accommodating space G1 of the apparatus main assembly 50, the aforementioned projections 59 and 60 come in contact with a first projection (unillustrated) and a second projection (unillustrated), respectively, which are provided on the apparatus main assembly 50 side, thereby the drum shutter (51, 52) is moved to the open position.

Embodiment 3

Figure 11:
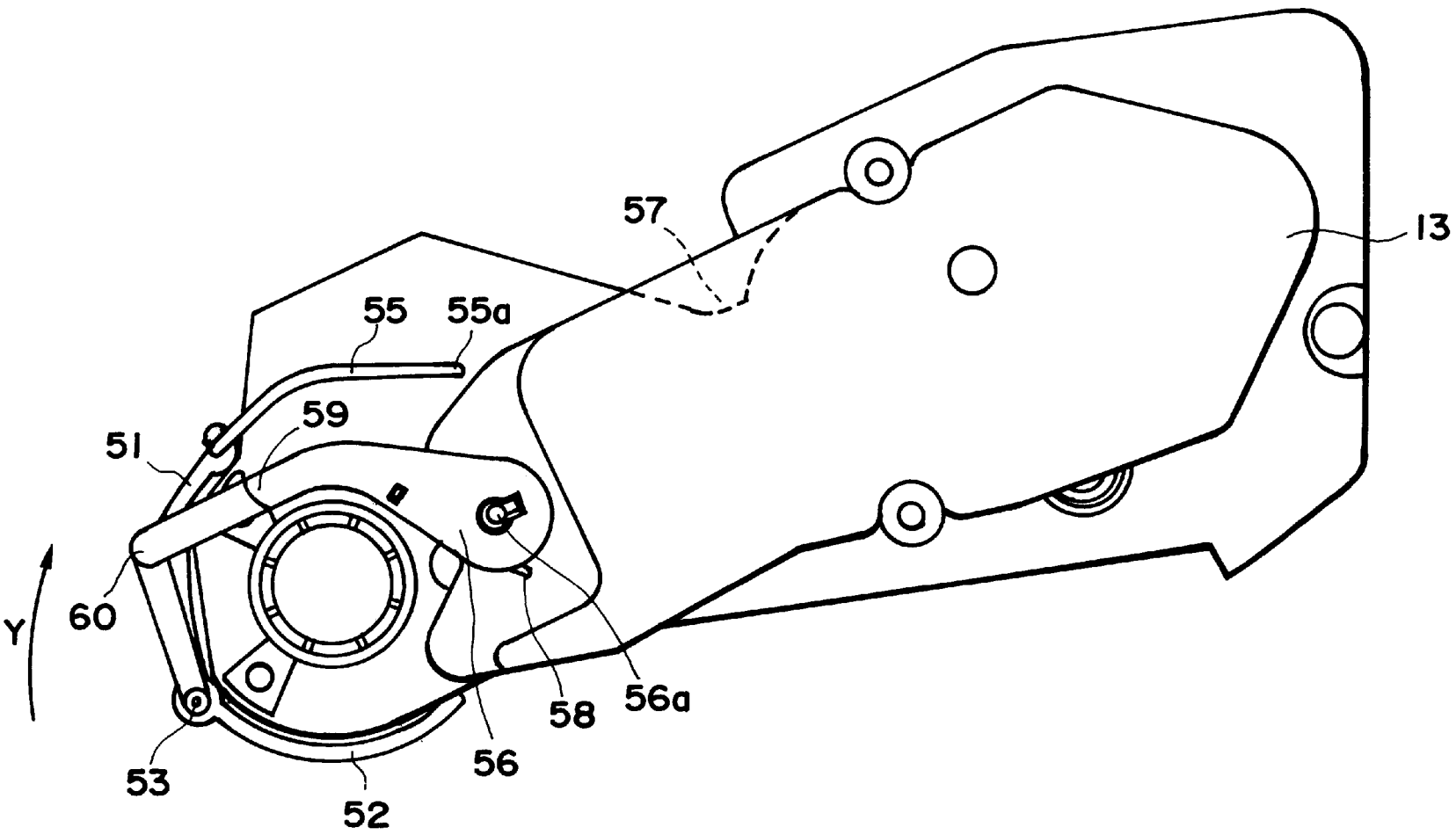
FIG. 11 is a perspective view of the process cartridge in the third embodiment of the present invention.
Figure 12:
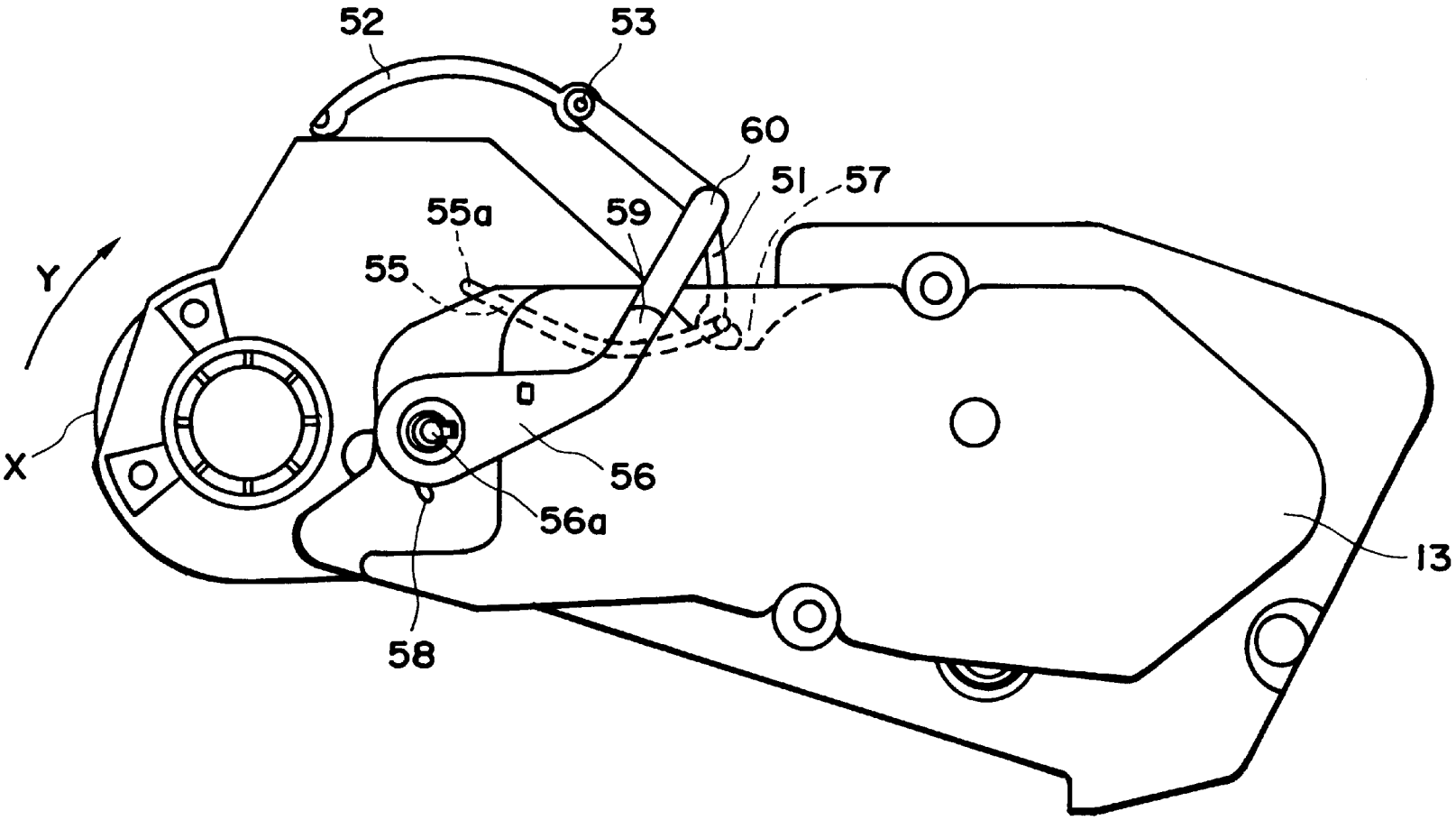
FIG. 12 is also a perspective view of the process cartridge in the third embodiment of the present invention.
Figure 13:
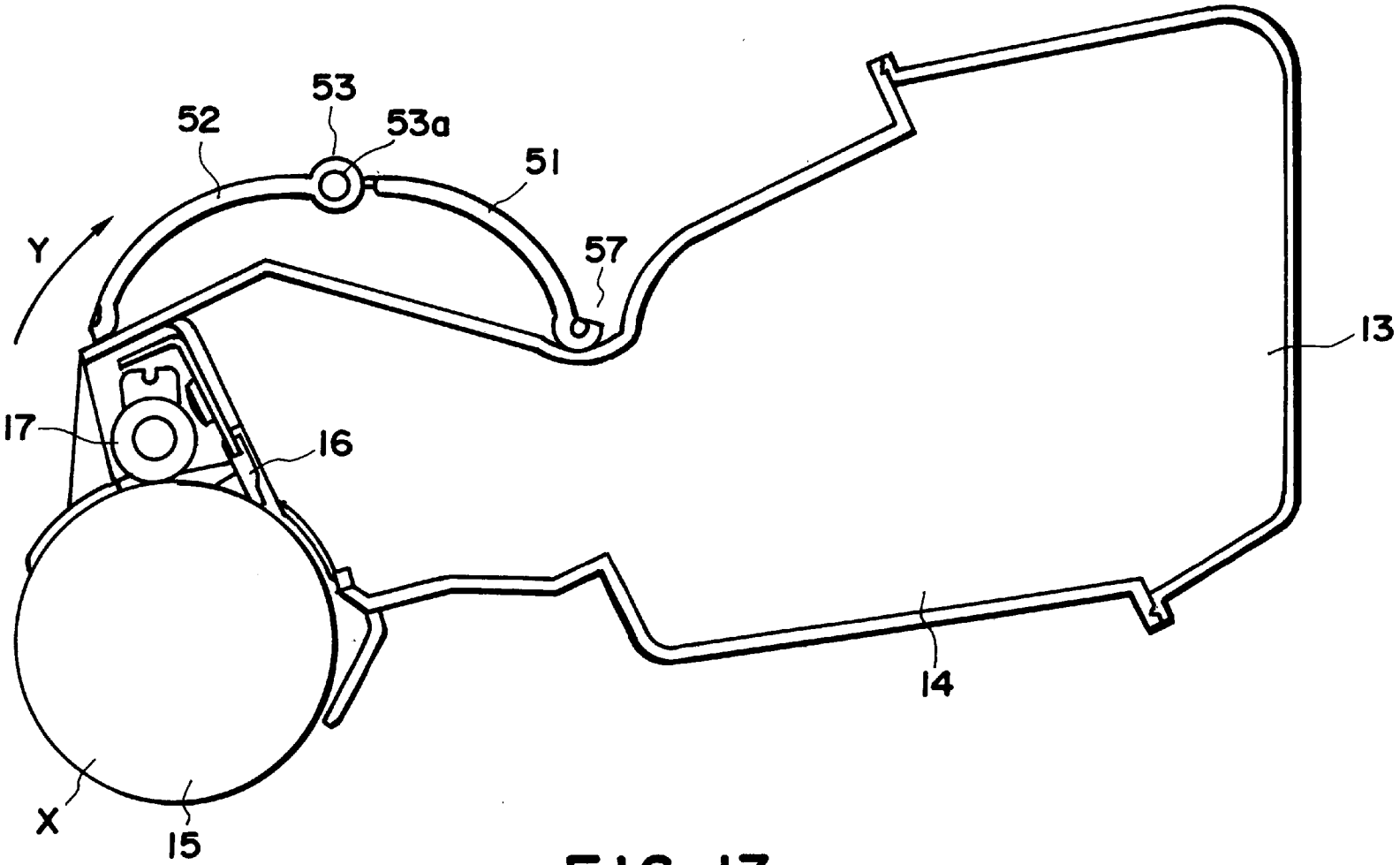
FIG. 13 is a side view of the process cartridge in the third embodiment of the present invention.

FIGS. 11, 12 and 13 depicts another embodiment of the present invention. Also in this embodiment, the drum shutter (51, 52) is constituted of two pieces of shutter members, and yet, the space which the process cartridge 13 occupies when it is in the apparatus main assembly 50 remains small.

In this embodiment, a space 57 in which the drum shutter (51, 52) is retractable is provided on the top side of the cartridge shell 14 of the process cartridge 13.

The space 57 in the form of a recess provided on the top side of the cartridge shell 14 is disposed in the path of the first shutter member 51 so that the height of the process cartridge 13 as it is in the apparatus main assembly 50 can be reduced by allowing the first shutter member 51 to be retracted into the space 57. With this reduction in height, the space which the process cartridge 13 occupies in the apparatus main assembly 50 becomes smaller, allowing he downsizing of the apparatus main assembly 50.

The structure employed in this embodiment to support the drum shutter is the same as the one described in the second embodiment, but the one described in the first embodiment may be employed.

The process cartridge according to the embodiment is summarized as follows.

The process cartridge detachably mountable to a main assembly of an image forming apparatus, comprises:

a cartridge frame 14;

an electrophotographic photosensitive drum 15;

a charging roller 17 for charging the electrophotographic photosensitive drum, wherein said charging roller is in contact with said electrophotographic photosensitive drum;

a cleaning blade 16 for removing residual developer from the electrophotographic photosensitive drum, wherein said cleaning blade is in contact with said electrophotographic photosensitive drum;

a cartridge shutter 51, capable of taking a closing position X for covering an exposed portion of said electrophotographic photosensitive drum exposed from said cartridge frame 14 and an open position Y for exposing a part of said electrophotographic photosensitive drum, wherein said cartridge shutter has a first shutter 51 and a second shutter 52 which are rotatably coupled relative to each other, said first shutter being disposed downstream of said second shutter with respect to a movement direction of said shutter toward the open position;

a first supporting member 55 for supporting said first shutter member of said cartridge shutter on said cartridge frame, said first supporting member supporting it adjacent one and the other ends thereof in a direction crossing with the opening direction at a downstream side with respect to the opening direction;

a second supporting member 56 for supporting, on said cartridge frame, a connecting portion between said first shutter member and second shutter member of said cartridge shutter, said second supporting member supporting it adjacent one end in the crossing direction;

a first coil spring 58 for urging said cartridge shutter toward said closing position;

a second coil spring 54 for urging said second shutter member toward said electrophotographic photosensitive drum at said closing position, wherein said second coil spring is provided between said first shutter member and second shutter member adjacent the other end in the crossing direction;

wherein said exposed portion includes an exposure light receiving portion 15*a* for said electrophotographic photosensitive member to receive information light emitted from main assembly of the apparatus, a developing function receiving portion 15*b* for development of a latent image formed on the photosensitive member, and a transferring portion 15*c* for transferring a toner image formed on said electrophotographic photosensitive member out onto a recording material, when said process cartridge is mounted to the main assembly of the apparatus, and wherein said exposed portions are covered by said first shutter member and second shutter member, and wherein said cartridge shutter takes a position above said cartridge frame when said process cartridge is mounted to a mounting position of the main assembly of the apparatus, and said shutter takes said open position.

Said first shutter and second shutter 51 and 52 are rotatably coupled by hinge 53 and 53*b* adjacent one and the other ends in a direction crossing with the opening direction; said first shutter is supported on said cartridge frame by a first supporting member adjacent one and the other ends in the crossing direction at a downstream side with respect to the opening direction; said shaft adjacent said one end is upported by a second supporting member; and said haft 53*a* adjacent said one end and said second supporting member 56 are integrally molded.

Said second supporting member 56 has a first projected portion 59 projected from said second supporting member in a direction crossing with the opening direction, and a second projected portion 60, wherein in the process of said process cartridge entering toward the mounting position, said first projected portion 59 is contacted to a first fixed portion (not shown) provided in the main assembly of the apparatus, and then, said second projected portion 60 is contacted to a second fixed portion (not shown) provided in the main assembly of the apparatus, by which said cartridge shutter is moved to said open position, wherein said second projected portion is projected coaxially with the shaft provided adjacent said one end.

Embodiment 4

In the first, second and third embodiments, the present invention was described with reference to a drum shutter constituted of two separate pieces of shutter members. However, it may be separated into three pieces, by which the volume occupied by said process cartridge 13 in the main assembly may be further reduced.

It should be noted here that the two shutter members do not need to be separate pieces. For example, they may be integrally formed as parts of a single piece drum shutter, being connected by a thin connecting part so that they can be moved as if pivoting about the connecting part. Further, the drum shutter may be constituted of three or more separate pieces of shutter members. In other words, the preceding embodiments are desirable whether the drum shutter is constituted of a single piece of shutter member, or two or more pieces.

The aforementioned cartridge frame and shutter members are formed of polystyrene, ABS resin, polycarbonate, polyethylene, polypropylene, or the like.

The process cartridge to which the present invention is applicable is not limited to those described in the preceding embodiments. Any process cartridge is compatible with the present invention as long as it is in the form of a cartridge which integrally comprises an electrophotographic photosensitive member, and at least one processing means among charging means, developing means and cleaning means, and is removably installable in the main assembly of an electrophotographic image forming apparatus.

As described in the foregoing, according to the foregoing embodiments, a covering member for covering the electrophotographic photosensitive member exposed through the cartridge frame, is constituted by a plurality of shutter members which are rotatable relative to each other and which are openably supported by a shutter supporting member, so that the area of the trace of the rotation of the drum shutter can be reduced, and therefore, the main assembly of the image forming apparatus can be downsized.

Furthermore, according to the foregoing embodiments, the opposite ends of each shutter member and the cartridge frame are coupled with two links, while each shutter member is one link, and the cartridge frame is one link, so that a common link is used for connection between the cartridge frame and the connecting portion of each shutter member. Thus a plurality of quardric crank mechanisms are established, so that it is easy to extend the trace of motion of each of the shutter member along the cartridge frame. This also makes the manufacturing easier.

Additionally, according to the foregoing embodiments, the opposite ends of each shutter member and the cartridge frame are coupled with two links, while each shutter member is one link, and the cartridge frame is one link, so that a common link is used for connection between the cartridge frame and the connecting portion of each shutter member, except for one end shutter member. Thus a plurality of quardric crank mechanisms are established, so that it is easy to extend the trace of motion of each of the shutter member along the cartridge frame. This also makes the manufacturing easier. Furthermore, said one end shutter member is rotated inwardly by an urging member, and therefore, the number of the links can be reduced.

According to the above described embodiments, two shutter members are supported by end supporting levers, at their end portions located opposite to their joint portions, and their joint portions are supported by a joint supporting levers, affording greater latitude in determining the length of each lever, and the position where each lever is attached;

therefore, this embodiment is applicable to wider varieties of process cartridges.

According to the above described embodiments, a process cartridge is provided with a member for pressuring the shutter member in the direction to cover the opening of the cartridge frame, and a driving portion which opens the shutter member by coming in contact with a member provided on the apparatus main assembly side when the process cartridge is inserted into the apparatus main assembly; therefore, the opening of the cartridge frame, through which an electrophotographic photosensitive member is exposed, is automatically exposed or covered by the drum shutter when the process cartridge is installed into, or removed from, the apparatus main assembly, improving operational efficiency.

According to the above described embodiments, when the drum shutter is in the closed state, the shutter members remain close to the peripheral surface of the electrophotographic photosensitive member; therefore, when the process cartridge is out of the apparatus main assembly, its size is small, rendering it easier to handle.

According to the above described embodiments, when the drum shutter is opened, the shutter members are moved to the top side of the cartridge frame; therefore, waste developer is not prevented from free-falling into a waste developer collector of cleaning means, which is disposed within the cartridge frame.

According to the above described embodiments, a recess in which the shutter member is retracted is provided on the top side of the cartridge frame; therefore, the size of the space provided in the apparatus main assembly to accommodate a process cartridge can be reduced.

As described above, according to the present invention, it is possible to provide a process cartridge whose shutter can be opened or closed in a manner to closely follow the exterior surface of the cartridge frame, and an electrophotographic image forming apparatus in which such a process cartridge is removably installable.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, comprising:

a cartridge frame;

an electrophotographic photosensitive member;

process means actable on said electrophotographic photosensitive member;

a cartridge shutter capable of taking a closing position for covering an exposed portion of said electrophotographic photosensitive member exposed from said cartridge frame and an open position for exposing a part of said electrophotographic photosensitive member, wherein said cartridge shutter has a first portion and a second portion which are swingable relative to each other, said first portion being disposed downstream of said second portion with respect to a movement direction of said shutter toward the open position;

wherein said cartridge shutter takes a position above said cartridge frame when said process cartridge is mounted to a mounting position of the main assembly of the apparatus, and said shutter takes said open position, wherein said second portion is urged toward said electrophotographic photosensitive member by an elastic force of a spring member at the closing position, wherein said spring member is a coil spring which is provided between said first portion and second portion adjacent one end in a direction crossing with a direction toward the open position of said shutter.

2. A cartridge according to claim 1, wherein said first portion and second portion are separated members, which are rotatably coupled by shafts adjacent one and the other ends in a direction crossing with a direction of movement of said shutter toward said open position; said first portion is supported on said cartridge frame by a first supporting member adjacent one and the other ends in the crossing direction at a downstream side with respect to the opening direction; said shaft adjacent said one end is supported by a second supporting member; and said shaft adjacent said one end and said second supporting member are integrally molded.

3. A cartridge according to claim 2, wherein said second supporting member has a first projected portion projected from said second supporting member in a direction crossing with the opening direction, and a second projected portion, wherein in the process of said process cartridge entering toward the mounting position, said first projected portion is contacted to a first fixed portion provided in the main assembly of the apparatus, and then, said second projected portion is contacted to a second fixed portion provided in the main assembly of the apparatus, by which said cartridge shutter is moved to said open position, wherein said second projected portion is projected coaxially with the shaft provided adjacent said one end.

4. A cartridge according to claim 1, wherein said process means includes a charging member for charging said electrophotographic photosensitive member.

5. A cartridge according to claim 1 or 4, wherein said process means includes a cleaning member for removing toner remaining on said electrophotographic photosensitive member.

6. A cartridge according to claim 5, wherein said cartridge shutter covers a part of an upper side of said cartridge frame when said process cartridge is mounted to a mounting position of the main assembly of the apparatus, and said shutter takes said open position.

7. A process cartridge detachably mountable to a main assembly of an image forming apparatus, comprising:

a cartridge frame;

an electrophotographic photosensitive member;

process means actable on said electrophotographic photosensitive member;

a cartridge shutter capable of taking a closing position for covering an exposed portion of said electrophotographic photosensitive member exposed from said cartridge frame and an open position for exposing a part of said electrophotographic photosensitive member, wherein said cartridge shutter has a first portion and a second portion which are swingable relative to each other, said first portion being disposed downstream of said second portion with respect to a movement direction of said shutter toward the open position;

wherein said cartridge shutter takes a position above said cartridge frame when said process cartridge is mounted to a mounting position of the main assembly of the apparatus, and said shutter takes said open position, wherein said exposed portion includes an exposure light receiving portion for said electrophotographic photosensitive member to receive information light emitted from the main assembly of the apparatus, a developing function receiving portion for development of a latent image formed on said electrophotographic photosensitive member, and a transferring portion for transferring a toner image formed on said electrophotographic photosensitive member onto a recording material, when said process cartridge is mounted to the main assembly of the apparatus.

8. A process cartridge according to claim 7, wherein the recording material is an intermediary transfer member for receiving a toner image from the electrophotographic photosensitive member, wherein said intermediary transfer member transfers the toner image transferred from said photosensitive member onto a transfer material.

9. A cartridge according to claim 7, wherein said second portion is urged toward said electrophotographic photosensitive member by elastic force of a spring member at the closing position.

10. A cartridge according to claim 7, wherein said first portion and second portion are separated members, which are rotatably coupled by shafts adjacent one and the other ends in a direction crossing with a direction of movement of said shutter toward said open position, wherein said first portion is supported on said cartridge frame by a first supporting member adjacent one and the other ends in the crossing direction at a downstream side with respect to the opening direction;

wherein said shaft adjacent said one end is supported by a second supporting member;

wherein said second supporting member has a first projected portion projected from said second supporting member in a direction crossing with the opening direction, and a second projected portion, wherein in the process of said process cartridge entering toward the mounting position, said first projected portion is contacted to a first fixed portion provided in the main assembly of the apparatus, and then, said second projected portion is contacted to a second fixed portion provided in the main assembly of the apparatus, by which said cartridge shutter is moved to said open position, wherein said second projected portion is projected coaxially with the shaft provided adjacent said one end.

11. A cartridge according to claim 7, wherein said process means includes a charging member for charging said electrophotographic photosensitive member.

12. A cartridge according to claim 7, wherein said process means includes a cleaning member for removing toner remaining on said electrophotographic photosensitive member.

13. A cartridge apparatus according to claim 7, wherein said cartridge shutter is supported, at an upstream portion thereof with respect to a movement direction of said cartridge shutter, on said cartridge frame by a supporting member.

14. A cartridge according to claim 7, wherein said cartridge shutter covers a part of an upper side of said cartridge frame when said process cartridge is mounted to a mounting position of the main assembly of said apparatus, and said shutter takes said open position.

15. A process cartridge detachably mountable to a main assembly of an image forming apparatus, comprising:

a cartridge frame;

an electrophotographic photosensitive drum;

a charging member for charging said electrophotographic photosensitive drum;

a cleaning member for removing toner remaining on said electrophotographic photosensitive drum;

a cartridge shutter capable of taking a closing position for covering an exposed portion of said electrophotographic photosensitive drum exposed from said cartridge frame and an open position for exposing a part of said electrophotographic photosensitive drum, wherein said cartridge shutter has a first shutter member and a second shutter member which are swingably coupled relative to each other, said first shutter member being disposed downstream of said second shutter member with respect to a movement direction of said shutter toward the open position;

a first elastic member for urging said cartridge shutter toward said closing position; and a second elastic member for urging said second shutter member toward said electrophotographic photosensitive drum at said closing position;

wherein said exposed portion includes an exposure light receiving portion for said electrophotographic photosensitive drum to receive information light emitted from the main assembly of the apparatus, a developing function receiving portion for development of a latent image formed on said electrophotographic photosensitive drum, and a transferring portion for transferring a toner image formed on said electrophotographic photosensitive drum onto a recording material, when said process cartridge is mounted to the main assembly of the apparatus, and wherein said exposed portions are covered by said first shutter member and second shutter member.

16. A cartridge according to claim 15, wherein said second elastic member is a coil spring which is provided between said first shutter member and second shutter member adjacent one end in a direction crossing with a direction toward the open position of said cartridge shutter.

17. A cartridge according to claim 16, wherein said first shutter member and second shutter member are rotatably coupled by shafts adjacent one and the other ends in a direction crossing with the opening direction; said first shutter member is supported on said cartridge frame by a first supporting member adjacent one and the other ends in the crossing direction at a downstream side with respect to the opening direction; said shaft adjacent said one end is supported by a second supporting member; and said shaft adjacent said one end and said second supporting member are integrally molded.

18. A process cartridge detachably mountable to a main assembly of an image forming apparatus, comprising:

a cartridge frame;

an electrophotographic photosensitive member;

process means actable on said electrophotographic photosensitive member;

a cartridge shutter capable of taking a closing position for covering an exposed portion of said electrophotographic photosensitive member exposed from said cartridge frame and an open position for exposing a part of said electrophotographic photosensitive member, wherein said cartridge shutter has a first portion and a second portion which are swingable relative to each other, said first portion being disposed downstream of said second portion with respect to a movement direction of said shutter toward the open position;

wherein said cartridge shutter takes a position above said cartridge frame when said process cartridge is mounted to a mounting position of the main assembly of the apparatus, and said shutter takes said open position, wherein said process means includes a cleaning member for removing toner remaining on said electrophotographic photosensitive member, wherein said cartridge shutter covers a part of an upper side of said cartridge frame when said process cartridge is mounted to a mounting position of the main assembly of the apparatus, and said shutter takes said open position, wherein said first shutter member and second shutter member are rotatably coupled by shafts adjacent one and the other ends in a direction crossing with the opening direction; said first shutter member is supported on said cartridge frame by a first supporting member adjacent one and the other ends in the crossing direction at a downstream side with respect to the opening direction; said shaft adjacent said one end is supported by a second supporting member; and said shaft adjacent said one end and said second supporting member are integrally molded.

19. A cartridge according to claim 18, wherein said second supporting member has a first projected portion projected from said second supporting member in a direction crossing with the opening direction, and a second projected portion, wherein in the process of said process cartridge entering toward the mounting position, said first projected portion is contacted to a first fixed portion provided in the main assembly of the apparatus, and then, said second projected portion is contacted to a second fixed portion provided in the main assembly of the apparatus, by which said cartridge shutter is moved to said open position, wherein said second projected portion is projected coaxially with said shaft provided adjacent said one end.

20. A cartridge according to claim 18, wherein said second portion is urged toward said electrophotographic photosensitive member by elastic force of a spring member at the closing position.

21. A cartridge according to claim 18, wherein said second supporting member has a first projected portion projected from said second supporting member in a direction crossing with the opening direction, and a second projected portion, wherein in the process of said process cartridge entering toward the mounting position, said first projected portion is contacted to a first fixed portion provided in the main assembly of the apparatus, and then, said second projected portion is contacted to a second fixed portion provided in the main assembly of the apparatus, by which said cartridge shutter is moved to said open position, wherein said second projected portion is projected coaxially with the shaft provided adjacent said one end.

22. A cartridge according to claim 18, wherein said exposed portion includes an exposure light receiving portion for said electrophotographic photosensitive member to receive information light emitted from the main assembly of the apparatus, a developing function receiving portion for development of a latent image formed on said electrophotographic photosensitive member, and a transferring portion for transferring a toner image formed on said electrophotographic photosensitive member onto a recording material, when said process cartridge is mounted to the main assembly of the apparatus.

23. A cartridge according to claim 18, wherein said process means includes a charging member for charging said electrophotographic photosensitive member.

24. A cartridge according to claim 18, wherein recording material is an intermediary transfer member for receiving a toner image from the electrophotographic photosensitive member, wherein said intermediary transfer member transfers the toner image transferred from said photosensitive member onto a transfer material.

25. A cartridge according to claim 18, wherein said cartridge shutter is supported, at an upstream portion thereof with respect to a movement direction of said cartridge shutter, on said cartridge frame by a third supporting member.

26. A process cartridge detachably mountable to a main assembly of an image forming apparatus, comprising:

a cartridge frame;

an electrophotographic photosensitive drum;

a charging roller for charging said electrophotographic photosensitive drum, wherein said charging roller is in contact with said electrophotographic photosensitive drum;

a cleaning blade for removing residual developer from said electrophotographic photosensitive drum, wherein said cleaning blade is in contact with said electrophotographic photosensitive drum;

a cartridge shutter capable of taking a closing position for covering an exposed portion of said electrophotographic photosensitive drum exposed from said cartridge frame and an open position for exposing a part of said electrophotographic photosensitive drum, wherein said cartridge shutter has a first shutter member and a second shutter member which are rotatably coupled relative to each other, said first shutter member being disposed downstream of said second shutter member with respect to a movement direction of said shutter toward the open position;

a first supporting member for supporting said first shutter member of said cartridge shutter on said cartridge frame, said first supporting member supporting it adjacent one and the other ends thereof in a direction crossing with the opening direction at a downstream side with respect to the opening direction;

a second supporting member for supporting, on said cartridge frame, a connecting portion between said first shutter member and second shutter member of said cartridge shutter, said second supporting member supporting it adjacent one end in the crossing direction;

a first coil spring for urging said cartridge shutter toward said closing position; and a second coil spring for urging said second shutter member toward said electrophotographic photosensitive drum at said closing position, wherein said second coil spring is provided between said first shutter member and second shutter member adjacent the other end in the crossing direction;

wherein said exposed portion includes an exposure light receiving portion for said electrophotographic photosensitive drum to receive information light emitted from the main assembly of the apparatus, a developing function receiving portion for development of a latent image formed on said electrophotographic photosensitive drum, and a transferring portion for transferring a toner image formed on said electrophotographic photosensitive drum onto a recording material, when said process cartridge is mounted to the main assembly of the apparatus, and wherein said exposed portions are covered by said first shutter member and second shutter member, and wherein said cartridge shutter takes a position above said cartridge frame when said process cartridge is mounted to a mounting position of the main assembly of the apparatus, and said cartridge shutter takes said open position.

27. A cartridge according to claim 26, wherein said first shutter member and second shutter member are rotatably coupled by said connecting portion in the form of shafts adjacent one and the other ends in a direction crossing with the opening direction; said first shutter member is supported on said cartridge frame by said first supporting member adjacent one and the other ends in the crossing direction at a downstream side with respect to the opening direction; said shaft adjacent said one end is supported by a second supporting member; and said shaft adjacent said one end and said second supporting member are integrally molded.

28. A cartridge according to claim 26 or 27, wherein said first supporting member includes a metal rod, and is mounted on said first supporting member so as to bridge said first shutter in the crossing direction, and wherein one end portion of said metal rod is rotatably mounted to one end of said cartridge frame, and the other end is rotatably mounted on the other end of said cartridge frame.

29. A cartridge according to claim 26 or 27, wherein said second supporting member has a first projected portion projected from said second supporting member in a direction crossing with the opening direction, and a second projected portion, wherein in the process of said process cartridge entering toward the mounting position, said first projected portion is contacted to a first fixed portion provided in the main assembly of the apparatus, and then, said second projected portion is contacted to a second fixed portion provided in the main assembly of the apparatus, by which said cartridge shutter is moved to said open position, wherein said second projected portion is projected coaxially with the shaft provided adjacent said one end.

30. A process cartridge according to claim 15 or 26, wherein the recording material is an intermediary transfer member for receiving a toner image from the electrophotographic photosensitive drum, wherein said intermediary transfer member transfers the toner image transferred from said photosensitive member onto a transfer material.

31. An apparatus according to claims 15 or 26, wherein said cartridge shutter is supported, at an upstream portion thereof with respect to a movement direction of said cartridge shutter, on said cartridge frame by a supporting member.

32. An electrophotographic image forming apparatus to which a process cartridge is detachably mountable, comprising:

a. a mounting member for detachably mounting a process cartridge;

said process cartridge including:

a cartridge frame;

an electrophotographic photosensitive drum;

a charging member for charging the electrophotographic photosensitive drum;

a cleaning member for removing toner remaining on the electrophotographic photosensitive drum;

a cartridge shutter capable of taking a closing position for covering an exposed portion of the electrophotographic photosensitive drum exposed from the cartridge frame and an open position for exposing a part of the electrophotographic photosensitive drum, wherein the cartridge shutter has a first shutter member and a second shutter member which are swingably coupled relative to each other, the first shutter member being disposed downstream of the second shutter member with respect to a movement direction of the shutter toward the open position;

a first elastic member for urging the cartridge shutter toward the closing position;

a second elastic member for urging the second shutter member toward the electrophotographic photosensitive drum at the closing position;

wherein the exposed portion includes an exposure light receiving portion for the electrophotographic photosensitive drum to receive information light emitted from the main assembly of the apparatus, a developing function receiving portion for development of a latent image formed on the electrophotographic photosensitive drum, and a transferring portion for transferring a toner image formed on the electrophotographic photosensitive drum onto a recording material, when the process cartridge is mounted to the main assembly of the apparatus, and wherein the exposed portions are covered by the first shutter member and second shutter member;

b. a developing member for developing a latent image formed on the electrophotographic photosensitive drum of the process cartridge mounted to said mounting member;

c. a fixed member for opening said cartridge shutter from the closing position to the open position by engagement with a projected portion projected from a supporting member for supporting the cartridge shutter on the cartridge frame, wherein said fixed member is engaged with said projected portion to move the cartridge shutter to the open position in the process of the process cartridge entering toward a mounting position of the main assembly of the apparatus; and d. a feeding member for feeding the recording material.

33. An apparatus according to claim 32, wherein the recording material is an intermediary transfer member for receiving a toner image from the electrophotographic photosensitive drum, wherein said intermediary transfer member transfers the toner image transferred from said photosensitive member onto a transfer material.

34. A process cartridge detachably mountable to a main assembly of an image forming apparatus, comprising:

a cartridge frame;

an electrophotographic photosensitive member;

process means actable on said electrophotographic photosensitive member;

a cartridge shutter capable of taking a closing position for covering an exposed portion of said electrophotographic photosensitive member exposed from said cartridge frame and an open position for exposing a part of said electrophotographic photosensitive member, wherein said cartridge shutter has a first portion and a second portion, said first portion being disposed downstream of said second portion with respect to a movement direction of said shutter toward the open position; and said first portion and second portion are rotatably coupled by a shaft; and a shaft supporting member for supporting said shaft on said cartridge frame, wherein said shaft supporting member is rotatably mounted to said cartridge frame at one longitudinal end portion thereof.

35. A cartridge according to claim 34, wherein said second portion is urged toward said electrophotographic photosensitive member by the elastic force of a spring member at the closing position.

36. A cartridge according to claim 35, wherein said spring member is a coil spring which is provided between said first portion and second portion adjacent one end in a direction crossing with a direction toward the open position of said shutter.

37. A cartridge according to claims 34, 35, and 36, wherein said first portion and second portion are separated members, and said shaft is disposed adjacent one and the other ends in a direction crossing with a direction of movement of said shutter toward said open position; said first portion is supported on said cartridge frame by a first supporting member adjacent one and the other ends in the crossing direction at a downstream side with respect to the opening direction; said shaft adjacent said one end is supported by said shaft supporting member; and said shaft adjacent said one end and said shaft supporting member are integrally molded.

38. A cartridge according to claim 37, wherein said shaft supporting member has a first projected portion projected from said shaft supporting member in a direction crossing with the opening direction, and a second projected portion, wherein in the process of said process cartridge entering toward the mounting position, said first projected portion is contacted to a first fixed portion provided in the main assembly of the apparatus, and said second projected portion is contacted to a second fixed portion provided in the main assembly of the apparatus, by which said cartridge shutter is moved to said open position.

39. A cartridge according to claim 34, wherein said exposed portion includes an exposure light receiving portion for said electrophotographic photosensitive member to receive information light emitted from the main assembly of the apparatus, a developing function receiving portion for development of a latent image formed on said electrophotographic photosensitive member, and a transferring portion for transferring a toner image formed on said electrophotographic photosensitive member onto a recording material, when said process cartridge is mounted to the main assembly of the apparatus.

40. A cartridge according to claim 34, wherein said process means includes a charging member for charging said electrophotographic photosensitive photographic member.

41. A cartridge according to claims 34 or 40, wherein said process means includes a cleaning member for removing toner remaining on said electrophotographic photosensitive member.

42. A process cartridge according to claim 34, wherein recording material is an intermediary transfer member for receiving a toner image from the electrophotographic photosensitive member, wherein said intermediary transfer member transfers the toner image transferred from said photosensitive member onto a transfer material.

43. A process cartridge according to claim 34, wherein said cartridge shutter is supported, at an upstream portion thereof with respect to a movement direction of said cartridge shutter, on said cartridge frame by a cartridge shutter supporting member.

44. A process cartridge detachably mountable to a main assembly of an image forming apparatus, comprising:

a cartridge frame;

an electrophotographic photosensitive member;

process means actable on said electrophotographic photosensitive member;

a cartridge shutter capable of taking a closing position for covering an exposed portion of said electrophotographic photosensitive member exposed from said cartridge frame and an open position for exposing a part of said electrophotographic photosensitive member, wherein said cartridge shutter has a first portion and a second portion which are swingable relative to each other, said first portion being disposed downstream of said second portion with respect to a movement direction of said shutter toward the open position;

wherein said cartridge shutter takes a position above said cartridge frame when said process cartridge is mounted to a mounting position of the main assembly of the apparatus, and said shutter takes said open position;

wherein said first portion and second portion are separated members, which are rotatably coupled by shafts adjacent one and the other ends in a direction crossing with a direction of movement of said shutter toward said open position; said first portion is supported on said cartridge frame by a first supporting member adjacent one and the other ends in the crossing direction at a downstream side with respect to the opening direction; said shaft adjacent said one end is supported by a second supporting member; and said shaft adjacent said one end and said second supporting member are integrally molded.

45. A cartridge according to claim 44, wherein said second portion is urged toward said electrophotographic photosensitive member by elastic force of a spring member at the closing position.

46. A cartridge according to claim 44, wherein said second supporting member has a first projected portion projected from said second supporting member in a direction crossing with the opening direction, and a second projected portion, wherein in the process of said process cartridge entering toward the mounting position, said first projected portion is contacted to a first fixed portion provided in the main assembly of the apparatus, and then, said second projected portion is contacted to a second fixed portion provided in the main assembly of the apparatus, by which said cartridge shutter is moved to said open position, wherein said second projected portion is projected coaxially with the shaft provided adjacent said one end.

47. A cartridge according to claim 44, wherein said exposed portion includes an exposure light receiving portion for said electrophotographic photosensitive member to receive information light emitted from the main assembly of the apparatus, a developing function receiving portion for development of a latent image formed on said electrophotographic photosensitive member, and a transferring portion for transferring a toner image formed on said electrophotographic photosensitive member onto a recording material, when said process cartridge is mounted to the main assembly of the apparatus.

48. A process cartridge according to claim 47, wherein the recording material is an intermediary transfer member for receiving a toner image from the electrophotographic photosensitive member, wherein said intermediary transfer member transfers the toner image transferred from said photosensitive member onto a transfer material.

49. A cartridge according to claim 44, wherein said process means includes a charging member for charging said electrophotographic photosensitive member.

50. A cartridge according to claim 44, wherein said process means includes a cleaning member for removing toner remaining on said electrophotographic photosensitive member.

51. An apparatus according to claim 44, wherein said cartridge shutter is supported, at an upstream portion thereof with respect to a movement direction of said cartridge shutter, on said cartridge frame by a supporting member.

* * * * *

UNITED STATES PATENT AND TRADEMARK OFFICE

CERTIFICATE OF CORRECTION

PATENT NO. : 6,002,896

DATED : December 14, 1999

INVENTOR(S) : Jun MIYAMOTO, et al.

It is certified that error appears in the above-identified patent and that said Letters Patent is hereby corrected as shown below:

COLUMN 5:

Line 56, "Also" should read --Also,--.

COLUMN 6:

Line 64, "Though" should read --Through--.

COLUMN 8:

Line 9, "tinuous." should read --tinuously.--.
Line 33, "above described" should read --above-described--.

COLUMN 11:

Line 21, "above" should read --above---.
Line 62, "covers" should read --cover--.

UNITED STATES PATENT AND TRADEMARK OFFICE

CERTIFICATE OF CORRECTION

PATENT NO. : 6,002,896

DATED : December 14, 1999

INVENTOR(S) : Jun MIYAMOTO, et al.

It is certified that error appears in the above-identified patent and that said Letters Patent is hereby corrected as shown below:

COLUMN 14:

Line 17, "in" (first occurrence) should read --in a--.

COLUMN 15:

Line 52, "haft" should read --shaft--.

COLUMN 16:

Line 45, "Thus" should read --Thus,--.
Line 55, "Thus" should read --Thus,--.
Line 62, "above described" should read --above-described--.
Line 65, "a" should be deleted.

UNITED STATES PATENT AND TRADEMARK OFFICE

CERTIFICATE OF CORRECTION

PATENT NO. : 6,002,896

DATED : December 14, 1999

INVENTOR(S) : Jun MIYAMOTO, et al.

It is certified that error appears in the above-identified patent and that said Letters Patent is hereby corrected as shown below:

COLUMN 17:

Line 3, "above described" should read --above-described--.
Line 16, "above described" should read --above-described--.
Line 22, "above described" should read --above-described--.
Line 28, "above described" should read --above-described--.

Signed and Sealed this

Twenty-seventh Day of February, 2001

Nicholas P. Godici

NICHOLAS P. GODICI

*Acting Director of the United States Patent and Trademark Office*

*Attest:*

*Attesting Officer*